US006113225A

United States Patent [19]

Miyata et al.

[11] Patent Number: 6,113,225

[45] Date of Patent: Sep. 5, 2000

[54] INK JET TYPE RECORDING HEAD

[75] Inventors: Yoshinao Miyata; Shinri Sakai; Tsutomu Hashizume, all of Nagano, Japan

[73] Assignee: Seiko Epson Corporation, Tokyo, Japan

[21] Appl. No.: 09/012,598

[22] Filed: Jan. 23, 1998

[30] Foreign Application Priority Data

| | | | |
|---|---|---|---|
| Jan. 24, 1997 | [JP] | Japan | 9-026074 |
| Sep. 17, 1997 | [JP] | Japan | 9-252215 |
| Sep. 19, 1997 | [JP] | Japan | 9-255522 |
| Dec. 3, 1997 | [JP] | Japan | 9-332779 |

[51] Int. Cl.[7] ..... B41J 2/045

[52] U.S. Cl. ..... 347/70

[58] Field of Search ..... 347/68, 70; 310/367

[56] References Cited

U.S. PATENT DOCUMENTS 5,933,167 8/1999 Shimada et al. ..... 347/70

FOREIGN PATENT DOCUMENTS 0 671 772 A1 9/1995 European Pat. Off. .
0 718 900 A2 6/1996 European Pat. Off. .
5286131 11/1993 Japan .
640030 2/1994 Japan .
WO98/18632 5/1998 WIPO .

*Primary Examiner*—Arthur T. Grimley
*Assistant Examiner*—William A. Noē
*Attorney, Agent, or Firm*—Sughrue, Mion, Zinn, Macpeak & Seas, PLLC

[57] ABSTRACT

An ink jet type recording head is capable of preventing the occurrence of cracks in a portion close to the circumferential wall of the pressure generating chamber of the piezoelectric active section so as to enhance the durability of the recording head.

The ink jet type recording head includes a piezoelectric vibrator having a vibrating plate composing a portion of a pressure generating chamber communicated with a nozzle opening, the upper surface of the vibrating plate functioning as a lower electrode, the piezoelectric vibrator also having a piezoelectric active section composed of a piezoelectric layer formed on the surface of the vibrating plate and also composed of an upper electrode formed on the surface of the piezoelectric layer, the piezoelectric active section being formed in a region opposed to the pressure generating chamber, wherein the vibration regulating section is composed of a wide width section in which the piezoelectric layer is wider than the primary portion of the piezoelectric active section, and the wide width section is extended to a side wall and arranged on one end side of the pressure generating chamber in the longitudinal direction.

28 Claims, 15 Drawing Sheets

INK JET TYPE RECORDING HEAD

BACKGROUND OF THE INVENTION

1. Field of the Invention

The present invention relates to an ink jet type recording head in which a portion of the pressure chamber communicating with the nozzle opening from which ink drops are jetted is composed of a vibrating plate, and a piezoelectric layer is formed on this vibrating plate and ink drops are jetted by the displacement of this piezoelectric layer.

2. Description of the Prior Art

There is provided an ink jet type recording head in which a portion of the pressure chamber communicating with the nozzle opening from which ink drops are jetted is composed of a vibrating plate, and this vibrating plate is deformed by the piezoelectric vibrator so that ink can be pressurized and ink drops are jetted from the nozzle opening. Concerning the ink jet type recording head described above, the following two types of ink jet recording heads are put into practical use. One is an ink jet type recording head in which a piezoelectric vibrator of the longitudinal vibration mode is used, which is extended and contracted in the axial direction of the piezoelectric vibrator. The other is an ink jet type recording head in which a piezoelectric vibrator of the deflecting vibration mode is used.

The former ink jet type recording head is advantageous in that a volume of the pressure generating chamber can be changed when an end surface of the piezoelectric vibrator comes into contact with the vibrating plate. Therefore, it is possible to manufacture an ink jet recording head suitable for printing at high speed. On the other hand, the following problems may be encountered in the above ink jet type recording head. In order to manufacture the above ink jet type recording head, it is necessary to perform a difficult manufacturing process in which the piezoelectric vibrator is cut into a comb-shape while the cut portions of the piezoelectric vibrator are made to coincide with arrangement pitches of the nozzle openings. Further, it is necessary to provide a difficult manufacturing process in which the thus cut piezoelectric vibrator is accurately positioned and fixed in the pressure generating chamber. As described above, the manufacturing process becomes complicated.

On the other hand, the latter ink jet type recording head is advantageous in that, for example, as shown in Japanese Unexamined Patent Publication No. 6-40030, a green sheet made of piezoelectric material is made to adhere onto the pressure generating chamber and fired at high temperature, which is a relatively simple process, to attach the piezoelectric vibrator onto the vibration plate. However, the following problems may be encountered in the above ink jet type recording head. Since deflecting vibration is used in the above ink jet type recording head, it is necessary to provide a relatively large area to arrange the above piezoelectric vibrator. Accordingly, it is difficult to arrange the piezoelectric vibrators at a high arrangement density.

On the other hand, as shown in Japanese Unexamined Patent Publication No. 5-286131, in order to solve the above problems caused in the latter ink jet type recording head, the following arrangement of the piezoelectric vibrators is proposed. A piezoelectric material layer is uniformly formed on the overall surface of the vibrating plate by means of film forming technique. This piezoelectric material layer is cut into a shape corresponding to the shape of the pressure generating chamber by the method of lithography, and the piezoelectric vibrator is independently formed in each pressure chamber.

When the above proposal is adopted, it is unnecessary to make the piezoelectric vibrator adhere onto the vibrating plate, and the piezoelectric vibrator can be made by a simple and precise method such as a method of lithography. Further, the above method is advantageous in that the thickness of the piezoelectric vibrator can be reduced, and it becomes possible to drive the ink jet type recording head at high speed.

In the above case, while the piezoelectric material layer is provided on the overall surface of the vibrating plate, when only an upper electrode is provided in each pressure generating chamber, the piezoelectric vibrator corresponding to each pressure generating chamber can be driven. However, when consideration is given to a displacement per unit driving voltage, and also when consideration is given to an intensity of stress impressed upon the piezoelectric layer in a portion opposed to the pressure generating chamber and a portion connected to the outside, it is preferable that the piezoelectric active section composed of the piezoelectric layer and the upper electrode is arranged so that it can not protrude from the pressure generating chamber. In the ink jet type recording head in which the above deflecting mode piezoelectric vibrator is used, the piezoelectric vibrator corresponding to each pressure generating chamber is covered with an insulating layer. On this insulating layer, there is respectively formed a window (referred to as a contact hole, hereinafter) for forming a connecting section with a lead electrode which supplies a voltage to drive each piezoelectric vibrator, and this window is arranged corresponding to each pressure generating chamber. The connecting section to connect each piezoelectric vibrator with the lead electrode is formed in the contact hole.

However, the ink jet type recording head in which the above piezoelectric vibrator of the deflecting mode is used is disadvantageous in that cracks tend to occur on the piezoelectric layer in a portion where the piezoelectric active section crosses a boundary between the pressure generating chamber and the circumferential wall. Further, when the contact hole is formed, cracks tend to occur in its periphery, so that the displacement is decreased. On the other hand, there is proposed a structure in which the piezoelectric vibrator is extended from one end portion of the pressure generating chamber onto the circumferential wall.

However, in the above structure, cracks tend to occur in a portion where the piezoelectric vibrator strides a boundary between the pressure generating chamber and the circumferential wall.

In the above ink jet type recording head, in order to enhance the displacement efficiency of the vibrating plate driven by the piezoelectric vibrator, there is proposed a structure in which thicknesses of the portions of the vibrating plate corresponding to both sides of the piezoelectric vibrator are reduced. However, according to the above structure by which the displacement can be increased, the occurrence of cracks is facilitated in a portion close to the circumferential wall of the pressure chamber as described above.

The above problems tend to occur especially when the piezoelectric material layer is formed by means of a film forming technique. The reason is that the piezoelectric material layer formed by means of a film forming technique is very thin and a high intensity of residual stress exists on the material layer, so that the rigidity and the mechanical strength are lower than those of the piezoelectric layer composed of the piezoelectric vibrator that is made to adhere to the pressure generating chamber.

The present invention has been achieved in view of the above circumstances.

SUMMARY OF THE PRESENT INVENTION

It is an object of the present invention to provide an ink jet type recording head capable of preventing the occurrence of cracks in a portion close to the circumferential wall of the pressure generating chamber of the piezoelectric active section so as to enhance the durability of the recording head.

The first embodiment of the present invention is an ink jet type recording head comprising: a piezoelectric vibrator having a vibrating plate composing a portion of a pressure generating chamber communicated with a nozzle opening, the upper surface of the vibrating plate functioning as a lower electrode, the piezoelectric vibrator also having a piezoelectric active section composed of a piezoelectric layer formed on the surface of the vibrating plate and also composed of an upper electrode formed on the surface of the piezoelectric layer, the piezoelectric active section being formed in a region opposed to the pressure generating chamber, wherein the piezoelectric active section is essentially arranged in a region opposed to the pressure generating chamber, the piezoelectric active section has a connecting section that crosses a boundary between the region opposed to the pressure generating chamber and the region opposed to a circumferential wall at least in one portion, and the piezoelectric active section also has a vibration regulating section for regulating a vibrating movement of the vibrating plate.

In the first embodiment described above, vibration of a portion close to the connecting section is regulated by the vibration regulating section, and a displacement is gradually caused. Accordingly, the occurrence of cracks in the connecting section can be prevented.

The second embodiment of the present invention is an ink jet type recording head in which the vibrating plate has a thin wall section, the thickness of which is smaller than the thickness of a portion corresponding to the piezoelectric active section, on both sides of the piezoelectric active section in the width direction.

In the above second embodiment, at least the vibrating plate in the arm section is made of thin film. Therefore, when the piezoelectric active section is driven, an amount of displacement can be increased.

The third embodiment of the present invention is an ink jet type recording head according to the first or the second embodiment, wherein the vibration regulating section is composed of a wide width section in which the piezoelectric layer is wider than the primary portion of the piezoelectric active section, and the wide width section is extended to a side wall and arranged on one end side of the pressure generating chamber in the longitudinal direction.

In the third embodiment, when the wide width section is provided in which the width of the piezoelectric layer is increased, vibration in a portion close to the connecting section is regulated, so that a displacement can be gradually caused and damage can be prevented.

The fourth embodiment of the present invention is an ink jet type recording head according to the third embodiment, wherein the upper electrode is essentially arranged on the piezoelectric layer of the vibration regulating section.

In the above fourth embodiment, the wide width section essentially becomes a piezoelectric active section, however, it is extended to the side wall. Therefore, vibration can be regulated.

The fifth embodiment of the present invention is an ink jet type recording head according to the third or the fourth embodiment, wherein the upper electrode is not arranged at least on one portion of the piezoelectric layer of the vibration regulating section.

According to the above fifth embodiment, for example, the upper electrode disposed in a fragile region such as an end portion, is removed, so that the occurrence of cracks in the region is prevented, and even if cracks are caused, electric breakdown can be prevented.

The sixth embodiment of the present invention is an ink jet type recording head according to one of the third to the fifth embodiment, wherein the width of the piezoelectric layer is gradually changed from the primary portion of the piezoelectric active section to the width section.

In the above sixth embodiment, there are no portions that tend to be damaged such as an acute angle portion of the pattern. Therefore, the durability can be enhanced.

The seventh embodiment of the present invention is an ink jet type recording head according to the first or the second embodiment, wherein the vibration regulating section is formed by changing a relative relation between the width of the pressure generating section and the width of the piezoelectric active section from a relative relation of the primary portion.

In the above seventh embodiment, when a relative relation between the width of the pressure generating chamber and the width of the piezoelectric active section is changed, vibration is regulated, and a displacement in a portion close to the connecting section can be minimized.

The eighth embodiment of the present invention is an ink jet type recording head according to the seventh embodiment, wherein the vibrating regulating section is composed of a narrow width section in which both the width of the piezoelectric layer of the piezoelectric active section close to the connecting section and the width of the upper electrode are reduced.

In the above eighth embodiment, since the width of a portion close to the connecting section of the piezoelectric active section which crosses a boundary of the end portion of the pressure generating chamber, is smaller than the widths of other portions, deflection is gradually caused from the circumferential wall boundary toward the pressure generating chamber. Accordingly, an intensity of stress of the portion which crosses the boundary becomes low, and the occurrence of cracks can be prevented and the durability can be enhanced.

The ninth embodiment of the present invention is an ink jet type recording head according to the seventh embodiment, wherein the vibration regulating section is composed of a narrow width section in which only the width of the upper electrode of the piezoelectric active section close to the connecting section is reduced.

In the ninth embodiment, when the width of the upper electrode is reduced, the narrow width section of the piezoelectric active section is formed. Since an inactive section is attached, the deflection is further reduced.

The tenth embodiment of the present invention is an ink jet type recording head according to one of the seventh to the ninth embodiments, wherein the width of the piezoelectric active section is gradually changed from the primary section to the narrow width section.

In the above tenth embodiment, there are no acute angle sections in which cracks tend to occur in the piezoelectric active section. Therefore, the durability can be enhanced.

The eleventh embodiment of the present invention is an ink jet type recording head according to one of the eighth embodiment to the tenth embodiment, wherein a thick film section, the entire film thickness of which is larger than the entire film thickness in the periphery of the piezoelectric active section, is arranged at least in a portion of the inner edge of the boundary between the pressure generating chamber and the circumferential wall on both sides of the narrow width section in the width direction.

In the above eleventh embodiment, vibration in a portion close to the circumferential wall is regulated by the thick film section, and the vibration plate is protected by the thick film section. Accordingly, the durability can be enhanced.

The twelfth embodiment of the present invention is an ink jet type recording head according to one of the eighth embodiment to the eleventh embodiment, wherein a distance from the end of the narrow width section inside the pressure generating chamber to a position at which the narrow width section crosses the boundary of one of the end portions of the pressure generating chamber in the longitudinal direction, is not less than ½ of the width of the pressure generating chamber.

In the above twelfth embodiment, it is possible to positively provide an effect in which deflection is gently caused from the circumferential wall boundary toward the pressure generating chamber.

The thirteenth embodiment of the present invention is an ink jet type recording head according to one of the eighth embodiment to the twelfth embodiment, wherein the connecting section is arranged at a position close to either side wall of the pressure generating chamber.

In the above thirteenth embodiment, since the connecting section exists close to the side wall, deflection is difficult to occur.

The fourteenth embodiment of the present invention is an ink jet type recording head according to one of the eighth embodiment to the twelfth embodiment, wherein a plurality of connecting sections are provided at one end portion of the pressure generating chamber in the longitudinal direction.

In the fourteenth embodiment, there are provided a plurality of narrow width sections at positions close to the connecting section, the deflection of which is restricted. Accordingly, it is possible to impress voltage easily upon the piezoelectric active section opposed to the pressure generating chamber while the deflection is suppressed.

The fifteenth embodiment of the present invention is an ink jet type recording head according to one of the eighth embodiment to the fourteenth embodiment, wherein the connecting section is arranged so that it crosses a boundary at the corner of the pressure generating chamber.

In the fifteenth embodiment, the narrow width section close to the connecting section crosses the corner. Therefore, it becomes further difficult for the deflection to occur.

The sixteenth embodiment of the present invention is an ink jet type recording head according to the fifteenth embodiment, wherein an opening angle of the corner toward the pressure chamber is an acute angle.

In the sixteenth embodiment, since the connecting section is formed in such a manner that it crosses an acute angle corner, the deflection of which is small, it becomes further difficult for the deflection to occur.

The seventeenth embodiment of the present invention is an ink jet type recording head according to one of the seventh embodiment to the sixteenth embodiment, wherein the vibration regulating section is formed when the width of the pressure generating chamber is reduced to be smaller than the widths of other portions.

In the seventeenth embodiment, when the width of the pressure generating chamber is partially reduced, vibration caused in a portion close to the connecting section can be restricted.

The eighteenth embodiment of the present invention is an ink jet type recording head according to the seventeenth embodiment, wherein a boundary between one side of the pressure generating chamber in the width direction and the circumferential wall is formed to be linear from the vibration regulating section to other portions.

In the eighteenth embodiment, at least one circumferential wall of the pressure generating chamber in the width direction can be formed to be linear. Accordingly, the durability can be enhanced. The nineteenth embodiment of the present invention is an ink jet type recording head according to the eighteenth embodiment, wherein an edge portion of the piezoelectric active section on one side in the width direction is formed to be linear in the longitudinal direction of the pressure generating chamber from the primary section to the vibration regulating section.

In the nineteenth embodiment, in a portion of the piezoelectric active section, the width of which is reduced, one side can be formed to be linear. Accordingly, the number of corners in the piezoelectric active section is decreased, so that the durability can be enhanced.

The twentieth embodiment of the present invention is an ink jet type recording head according to one of the first embodiment to the nineteenth embodiment, wherein an insulating layer is formed on the upper surface of the piezoelectric active section, and a lead electrode used for impressing voltage on the piezoelectric active section and a contact section for connecting the electrode are arranged in a contact hole formed on the insulating layer.

In the twentieth embodiment, voltage is impressed upon the piezoelectric active section via the contact section which is formed via the insulating layer.

The twenty-first embodiment of the present invention is an ink jet type recording head according to one of the first embodiment to the twentieth embodiment, wherein a lead electrode used for impressing voltage on the piezoelectric active section and a contact section for connecting the electrode are arranged in a portion opposed to the circumferential wall of the pressure generating chamber.

In the twenty-first embodiment, voltage is impressed upon the piezoelectric active section via the contact hole formed on the circumferential wall. The twenty-second embodiment of the present invention is an ink jet type recording head according to one of the first embodiment to the twenty-first embodiment, wherein a signal transmitting passage is formed when the width of the upper electrode is reduced from a region exceeding the boundary of the wide width section on one side of the pressure generating chamber.

In the twenty-second embodiment, it is possible to ensure a creeping distance between the lower and the upper electrode. Therefore, a creeping discharge can be prevented, and further it is possible to greatly reduce the electrostatic capacity and the piezoelectric loss.

The twenty-third embodiment of the present invention is an ink jet type recording head according to one of the first embodiment to the twenty-second embodiment, wherein at least a contact surface of the upper electrode coming into contact with the piezoelectric layer is made of conductive oxide film.

In the twenty-third embodiment, it is possible to prevent the deterioration of the piezoelectric characteristic caused by the lack of oxygen on the piezoelectric layer.

The twenty-fourth embodiment of the present invention is an ink jet type recording head according to one of the first embodiment to the twenty-third embodiment, wherein the pressure generating chamber is formed when anisotropic etching is conducted on a single crystal silicon base plate and each layer of the piezoelectric vibrator is formed by the methods of film formation and lithography.

In the twenty-fourth embodiment, it is possible to relatively easily mass-produce an ink jet type recording head having nozzle openings arranged in a highly dense manner.

BRIEF DESCRIPTION OF THE DRAWINGS

FIG. 3 is a plan view showing the structure of the piezoelectric layer, upper electrode and lower electrode of the ink jet type recording head of Embodiment 1 of the present invention, wherein FIG. 3 is drawn in relation to the pressure generating chamber.

DESCRIPTION OF THE PREFERRED EMBODIMENTS

Referring to the embodiments, the present invention will be explained below.

EMBODIMENT 1

Figure 1:
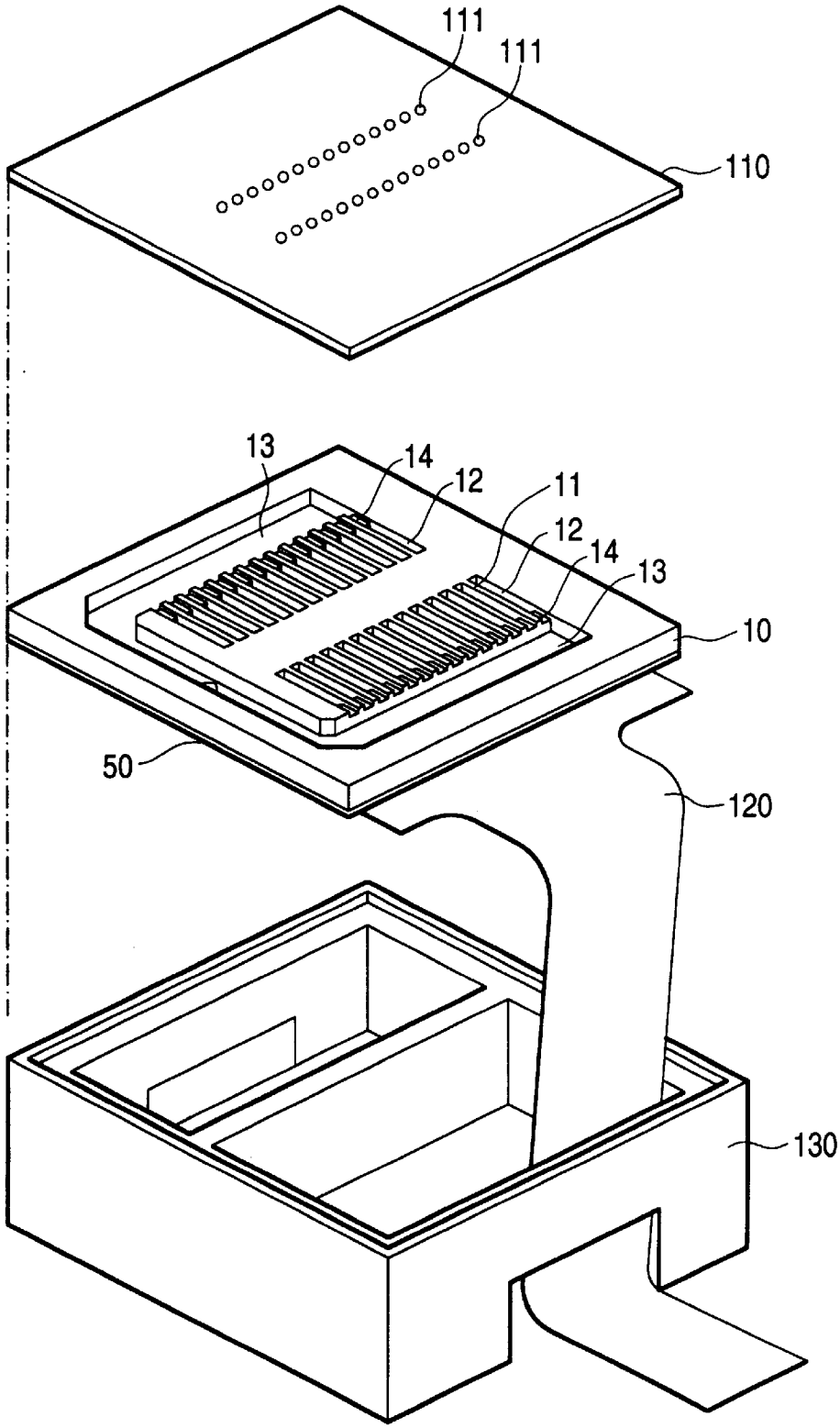
FIG. 1 is a perspective arrangement view of the ink jet type recording head of Embodiment 1 of the present invention.
Figure 2:
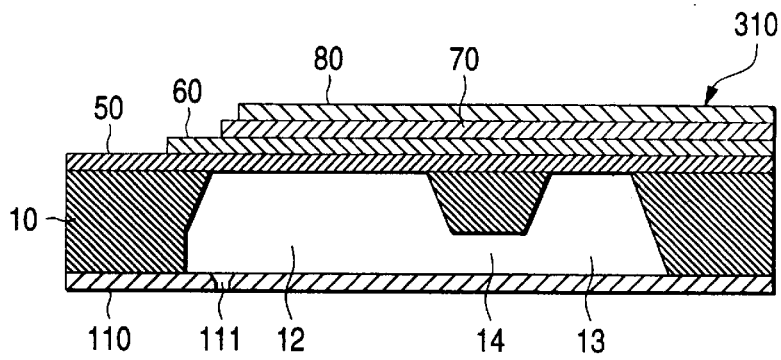
FIGS. 2(*a*) and (*b*) are cross-sectional views of the ink jet type recording head shown in FIG. 3, taken along the line 2A—2A and 2B—2B, respectively.
Figure 2:
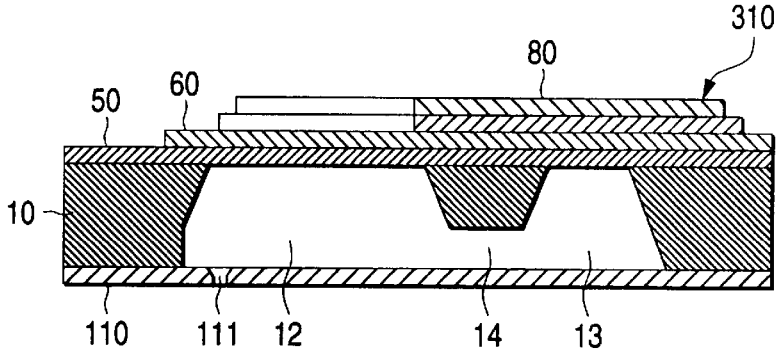
Figure 3:
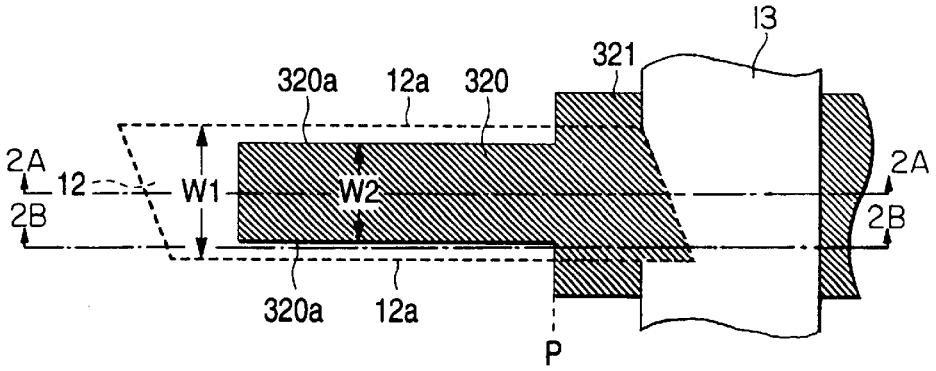

FIG. 1 is a perspective arrangement view of the ink jet type recording head of Embodiment 1 of the present invention. FIGS. 2(*a*) and 2(*b*) are cross-sectional views respectively showing different sections of one pressure generating chamber taken in the longitudinal direction, that is, FIG. 2(*a*) is a cross-sectional view taken on the center line of the piezoelectric vibrator 310 along the line 2A—2A in FIG. 3, and FIG. 2(*b*) is a cross-sectional view taken at the side end portion of the piezoelectric vibrator 310 along the line 2B—2B in FIG. 3. FIG. 3 is a view showing a positional relation between the cross-sectional views of FIGS. 2(*a*) and 2(*b*).

As shown in the drawings, there is provided a passage forming base plate 10, which is composed of a single crystal silicon base plate. One surface of the passage forming base pate 10 is an opening surface, and a piece of elastic film 50 made of silicon oxide is formed on the other surface. On the opening surface of the passage forming base plate 10, there are provided pressure generating chambers 12 and a reservoir 13 which are formed by means of anisotropic etching and sectioned by bulkheads 11. Further, there are provided ink feed ports 14 each of which is composed of a recess through which the pressure generating chambers 12 are communicated with the reservoirs 13 at a constant flow resistance.

In a region on the elastic film 50 opposed to each pressure generating chamber 12, there is provided a piezoelectric vibrator 310 (see FIGS. 2(*a*) and 2(*b*) which is made by the method of film formation, the details of which will be described later.

On the nozzle plate 110, there are formed nozzle openings 111 through which the pressure generating chambers 12 are communicated at one end side. This nozzle plate 110 is fixed in such a manner that the opening of the passage forming base plate 10 is covered with the nozzle plate 110.

In this arrangement, the passage forming base plate 10 is connected with a flexible cable 120 for supplying drive signals to the piezoelectric vibrators 310. The passage forming base plate 10 is fixed to and held by a head case 130.

As shown in FIG. 2(*a*), each of the piezoelectric vibrators 310 is composed of a piezoelectric active section 320 which includes: a lower electrode film 60 provided on the elastic film 50 in such a manner that the lower electrode film 60 covers all regions of the pressure generating chambers 12, ink feed port 14 and reservoir 13; a piezoelectric layer 70 formed on this lower electrode film 60; and an upper electrode film 80, wherein these members are respectively laminated on each other. As shown in FIG. 3, the piezoelectric active section 320 extends from the nozzle opening side of the pressure generating chamber 12 to the reservoir 13 side and exceeds the end portion of the reservoir 13. In a region where the piezoelectric active section 320 is opposed to each pressure generating chamber 12, the width W2 of the piezoelectric active section 320 is essentially a little smaller than the width W1 of the pressure generating chamber 12, and the side edges 320*a*, of the piezoelectric active section 320 are located inside the boundaries 12*a* between the pressure generating chamber 12 and the bulkheads 11. In a region of the piezoelectric active section 320 on the ink feed port 14 side of the pressure generating chamber 12, the width W3 of the piezoelectric active section 320 is larger than the width W1 of the pressure generating chamber 12, that is, the wide width section 321, the width of which is W3, is formed at the position P located inside of the boundary 12*b* of the end portion of the pressure generating chamber 12, and the piezoelectric active section 320 extends to a terminal section in which the piezoelectric active section 320 is connected with the flexible cable 120.

In this embodiment, when a signal is impressed upon the piezoelectric vibrator 310 from the outer drive circuit via the flexible cable 120, the piezoelectric vibrator 310 is deflected, so that the pressure generating chamber 12 is contracted. When the pressure generating chamber 12 is contracted, ink in the pressure generating chamber 12 is pressurized. A portion of the thus pressurized ink is jetted from the nozzle opening 111 in the form of ink drops. After the ink drops have been jetted out from the nozzle opening 111 and the piezoelectric vibrator 310 has returned to the initial condition, the pressure generating chamber 12 is expanded, and ink flows from the reservoir 13 into the pressure generating chamber 12 via the ink feed port 14.

In this connection, in a region where the piezoelectric active section 320 is opposed to the pressure generating chamber 12 and displaced for deflection, the side edges 320*a*[, 320*a*] of the piezoelectric active section 320 are located inside of the boundaries 12*a*[, 12*a*] on the side of the pressure generating chamber 12. Accordingly, a restricting force given to the piezoelectric active section 320 by the passage forming base plate 10 is reduced as small as possible, so that the piezoelectric active section 320 is greatly deflected. Therefore, the piezoelectric active section 320 generates an ink pressure necessary for jetting ink even when a low drive voltage is impressed.

On the other hand, at a position close to the boundary 12*b* of the end portion on the ink feed port side, the width W3 of the piezoelectric active section 320 is larger than the width W1 of the pressure generating chamber 12. Therefore, the deflecting displacement is restricted when the piezoelectric active section 320 is driven, and the concentration of stress is reduced.

Figure 4:
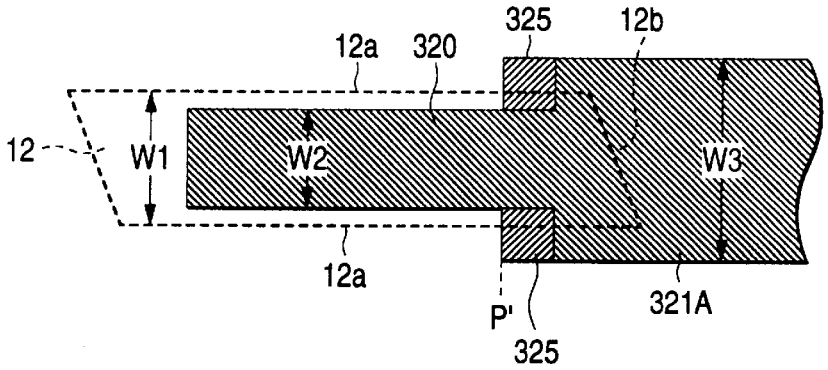
FIG. 4 is a view showing a structure of the piezoelectric vibrator of one variation of Embodiment 1 of the present invention.

FIG. 4 is a view showing a variation of this embodiment. In this embodiment, the upper electrode film 80 is not formed in a portion of the wide width section 321 in the above embodiment, but inactive sections 325[, 325] are provided in which the piezoelectric layer 70 is exposed and the inactive sections 325[, 325] become inert. The inactive sections 325, which are inert, are located outside of the width W2 of the primary portion of the piezoelectric active section 320 at the inner end portion of the pressure generating chamber 12 in the region where the width of the piezoelectric layer 70 is large. Other portions are the wide width section 321A of the piezoelectric active section 320.

In this embodiment, in a portion close to the position P' at which the width starts extending, the concentration of stress tends to occur most frequently on the piezoelectric layer 70. This portion becomes the inert region (inactive section) 325. Accordingly, cracks are seldom caused in this portion. Even if cracks are caused in the inactive section 325, since no upper electrode film 80 exists in this region, the occurrence of electric breakdown can be prevented.

Figure 5:
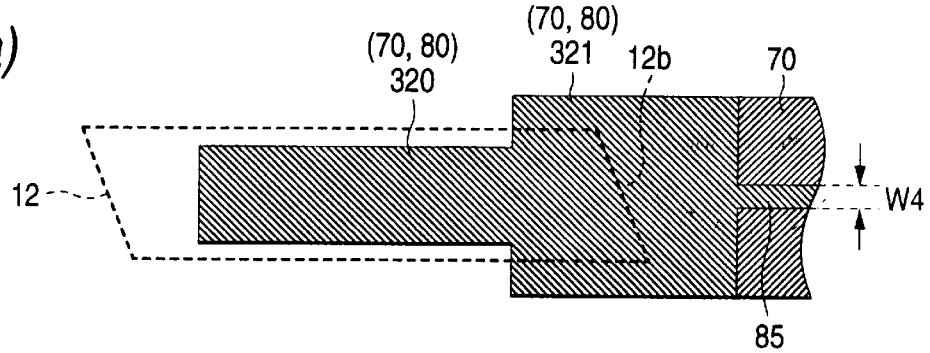
FIGS. 5(*a*) and (*b*) are views showing a structure of the piezoelectric vibrator of another variation of Embodiment 1 of the present invention.
Figure 5:
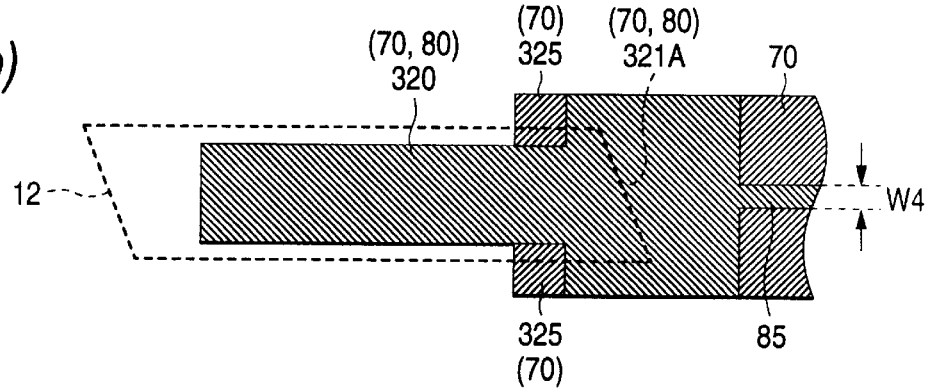

In this connection, in the above embodiment, the lead section is formed in such a manner that the width of the wide width section 321 is determined to be W3. However, as shown in FIGS. 5(*a*) and 5(*b*), when the lead section 85 of the width W4, which is determined to be as small as possible under the condition that a drive signal can not be attenuated, is formed on the upper electrode film 80, it is possible to maintain the creeping distance between the lower electrode film 60 and the upper electrode film 80. Therefore, the creeping discharge can be prevented, and at the same time, the electrostatic capacity of the signal feed passage and the piezoelectric loss can be remarkably reduced, and the deterioration of the response speed and the generation of heat can be suppressed.

Figure 6:
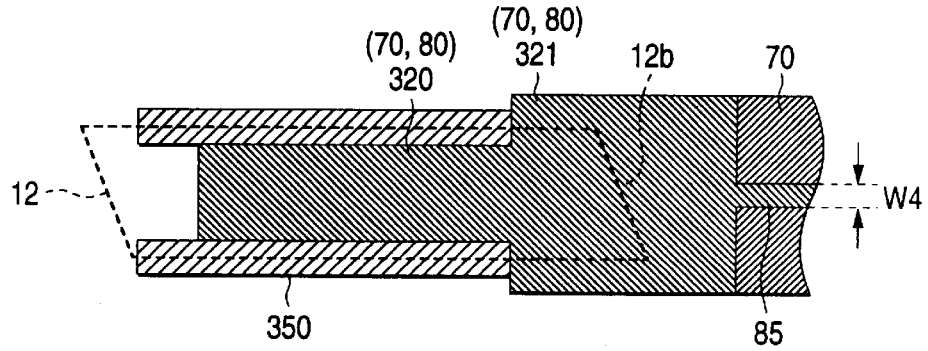
FIG. 6 is a view showing a structure of the piezoelectric vibrator of still another variation of Embodiment 1 of the present invention.

In the above embodiment, the vibrating plates arranged at least on both sides in the width direction of the primary portion of the piezoelectric active section 320, that is, the vibrating plates of the arm section may be formed to be thin as compared with other portions so that the vibrating plates can be easily displaced in the case of driving. For example, as shown in FIG. 6, there are provided lower electrode film removing sections 350 on both sides in the width direction of the piezoelectric active section 320. From the lower electrode film removing section 350, the lower electrode film 60 is completely removed. However, a thin film may be formed in such a manner that a portion of the lower electrode film 60 in the thickness direction is removed, or alternatively a portion of the elastic film 50 in the thickness direction may be removed. The lower electrode film removing section 350 may be arranged not only on both sides in the width direction but also outside of the edge portion.

Figure 7:
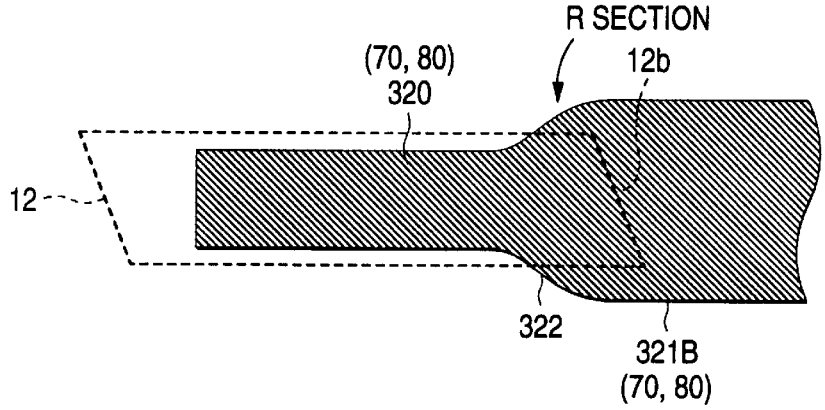
FIG. 7 is a view showing a structure of the piezoelectric vibrator of still another variation of Embodiment 1 of the present invention.

Further, in the above embodiment, the width of the primary portion of the piezoelectric active section 320 may be gradually extended so that the width of the region can be gradually changed into the wide width section. That is, as shown in FIG. 7, the width of the wide width section 321B at the inside end portion with respect to the pressure generating chamber 12 is gradually changed so that it can be formed into the width changing section 322. Especially when the inner edge of a boundary between the primary section and the wide width section is formed into an R section, it is possible to further reduce the occurrence of cracks in the inside edge section of the wide width section.

EMBODIMENT 2

FIGS. 8 to 14 are views showing an ink jet type recording head related to Embodiment 2. The essential structure of this ink jet type recording head is similar to that of the embodiment described before except for one point that a common ink chamber is formed by a different member instead of the reservoir 13 arranged on the passage forming base plate 10. Therefore, like reference characters are used to indicate like parts.

Figure 8:
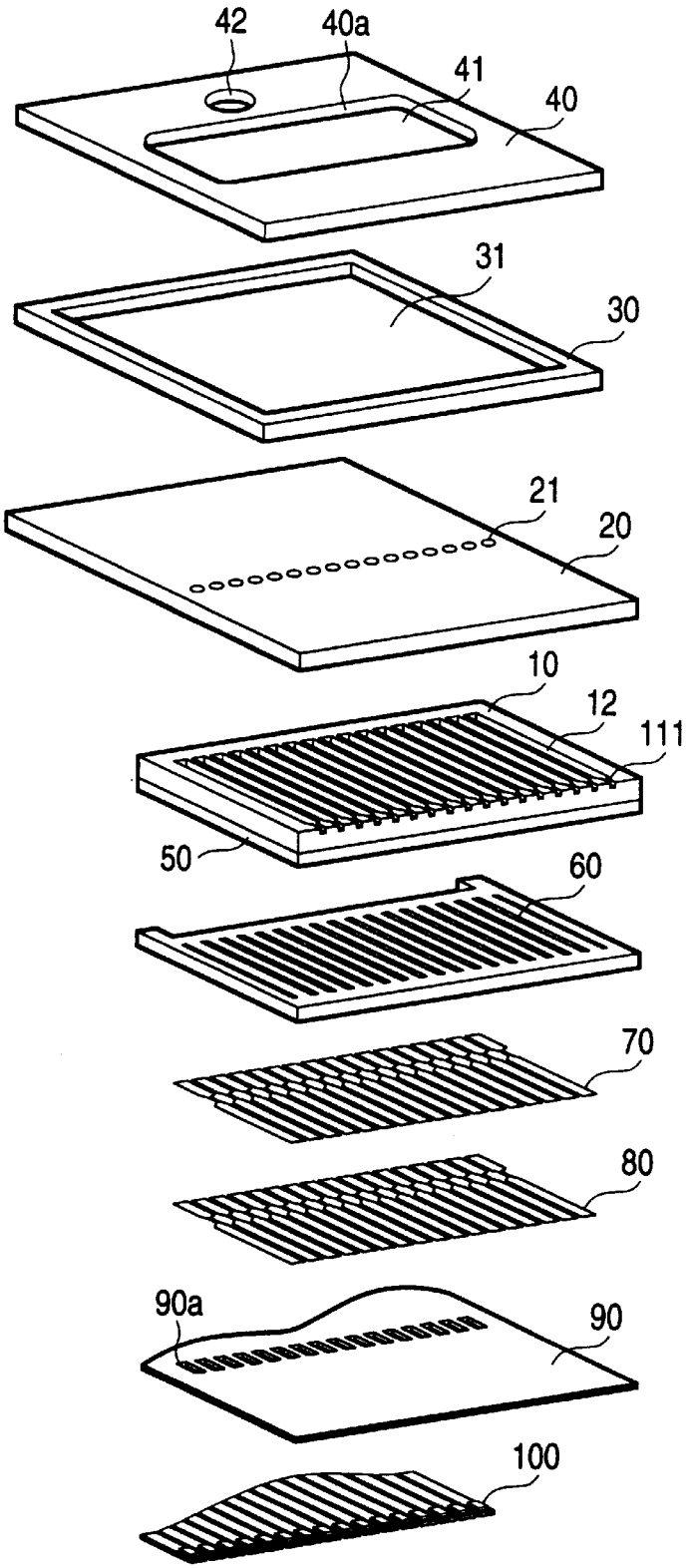
FIG. 8 is an exploded perspective view of the ink jet type recording head of Embodiment 2 of the present invention.
Figure 9:
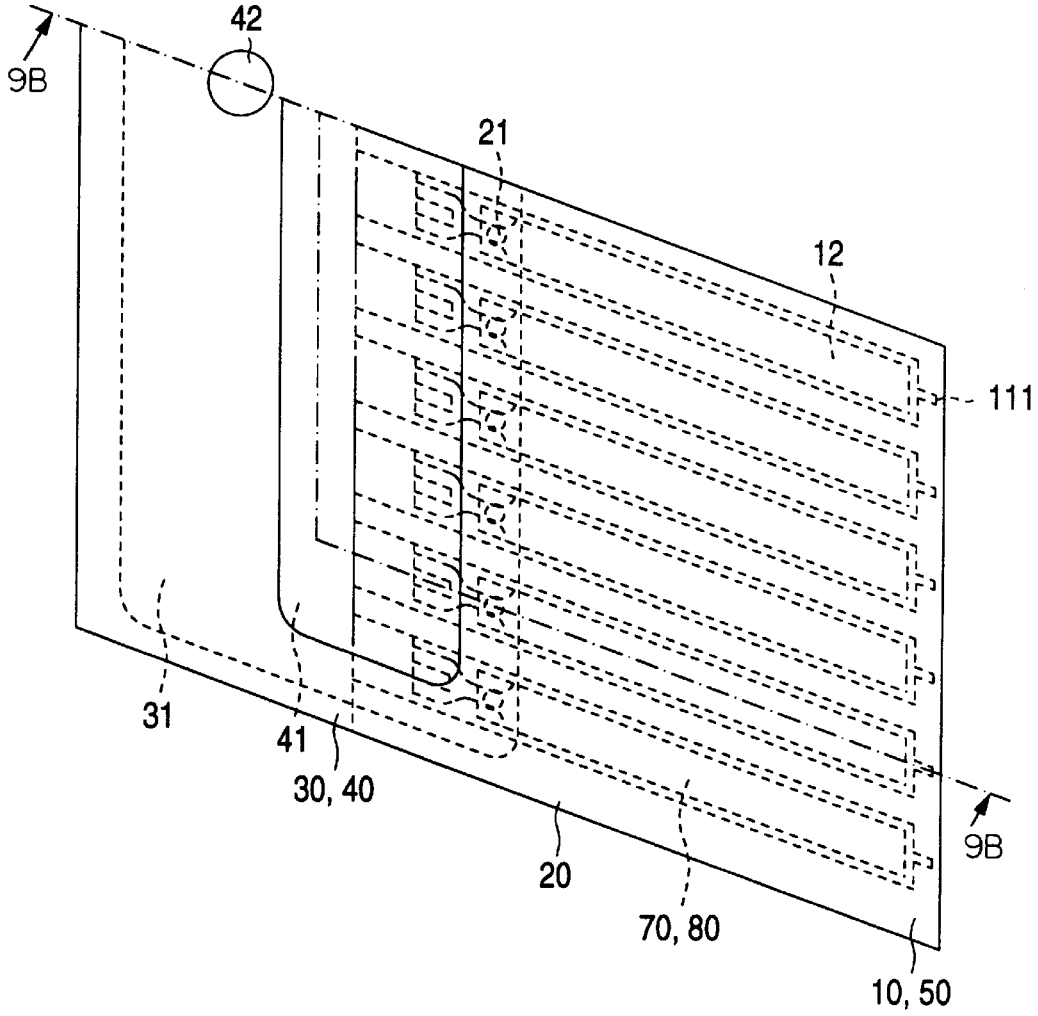
FIGS. 9(*a*) and (*b*) are views of the ink jet type recording head of Embodiment 2 of the present invention, wherein FIG. 9(*a*) is a plan view of the structure derived by assembling the member shown in FIG. 8 and FIG. 9(*b*) is a cross-sectional view of FIG. 9(*a*) cut along 9B—9B.
Figure 9:
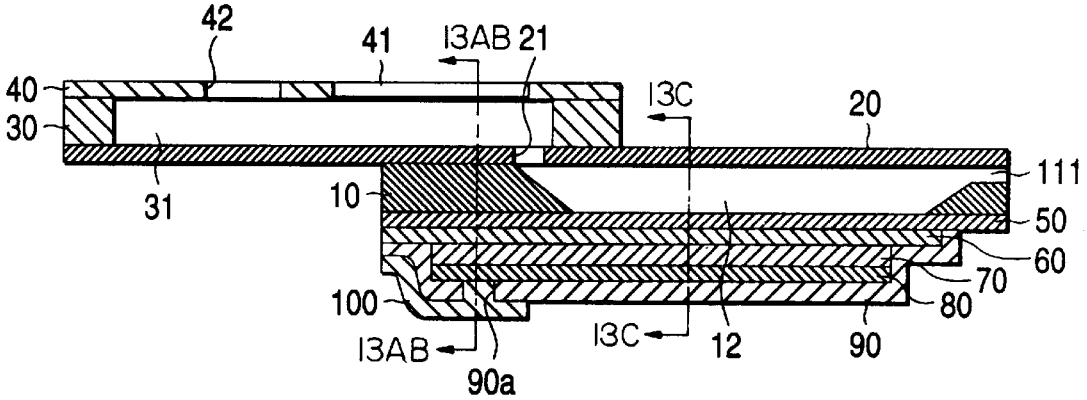

FIG. 8 is an exploded perspective arrangement view of the ink jet type recording head of an embodiment of the present invention. FIG. 9(*a*) is a plan view, and FIG. 9(*b*) is a cross-sectional view in the longitudinal direction of one of the pressure generating chambers.

As shown in the drawing, in this embodiment, the passage forming base plate 10 is composed of a single crystal silicon base plate, the face orientation of which is (110). Thickness of the passage forming base plate 10 is usually 150 to 300 μm. It is preferable that the thickness of the passage forming base plate 10 is 180 to 280 μm. It is more preferable that the thickness of the passage forming base plate 10 is approximately 220 μm. The reason why the thickness of the passage forming base plate 10 is determined as described above is that the arranging density of the pressure chambers can be increased while the rigidity of the bulkhead between the adjoining pressure generating chambers is maintained high.

One of the surfaces of the passage forming base plate 10 is an opening surface, and on the other surface, there is provided an elastic film 50, the thickness of which is 0.1 to 2 μm, made of silicon dioxide previously formed by means of heat oxidation.

On the other hand, on the opening surface of the passage forming base plate 10, there are provided nozzle openings 111 and pressure generating chambers 12 which are formed by conducting anisotropic etching on a single crystal silicon base plate.

In this case, the anisotropic etching is conducted in the following manner. When the single crystal silicon base plate is dipped in an alkali solution such as a solution of KOH, it is gradually corroded, and the first face (111) appears, which is perpendicular to the face (110), and also the second face (111) appears which forms an angle of about 70° with the first face (111) and also forms an angle of about 35° with the above face (110). In the above anisotropic etching, the characteristic is used in which the etching rate of the face (111) is approximately 1/180 with respect to the etching rate of the face (110). By the above anisotropic etching, a shape of a parallelogram can be formed which is formed by the first faces (111), the number of which is two, and the second faces (111), the number of which is two, which are inclined with respect to the first faces. On the basis of forming the above parallelogram, it is possible to conduct a precise machining, and the pressure generating chambers 12 can be arranged at a high arrangement density.

In this embodiment, the long side of each pressure generating chamber 12 is formed by the first face (111), and the short side is formed by the second face (111). This pressure generating chamber 12 can be formed when etching is conducted on the passage forming base plate 10 in such a manner that the etched portion substantially penetrates the passage forming base plate 10 so that it can reach the elastic film 50. In this connection, the elastic film 50 is seldom corroded by the alkali solution used for etching the single crystal silicon base plate.

On the other hand, the width of each nozzle opening 111 communicated with one end of each pressure generating chamber 12 is smaller than the width of the pressure generating chamber 12. Further, the depth of each nozzle opening 111 is smaller than the depth of the pressure generating chamber 12. That is, the nozzle opening 111 is formed when the single crystal silicon base plate is etched in the thickness direction to the middle of the thickness. That is, the nozzle opening 111 is formed when half-etching is conducted on the single crystal silicon base plate. In this connection, half-etching is conducted by adjusting the etching time.

In this case, the size of the pressure generating chamber 12 which generates pressure for jetting ink drops and the size of the nozzle opening 111 from which ink drops are jetted out are optimized in accordance with a quantity of ink to be jetted out, jetting speed of ink drops and jetting frequency. For example, when ink drops, the number of which is 360 per inch, are recorded, it is necessary to form the nozzle opening 111 with high accuracy, the groove width of which is several tens μm.

Each pressure generating chamber 12 and the common ink chamber 31, which will be described later, are communicated with each other via the ink feed communicating port 21 formed at a position on a sealing plate 20 corresponding to one end portion of each pressure generating chamber 12. Ink is fed from the common ink chamber 31 via this ink feed communicating port 21 and distributed to each pressure generating chamber 12.

Figure 10:
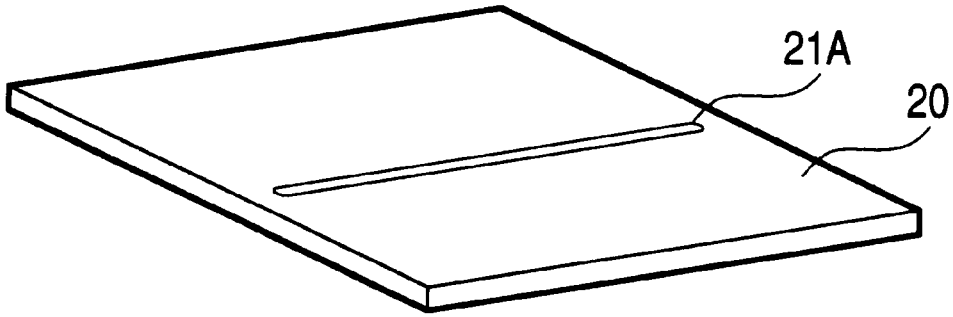
FIGS. 10(*a*) and (*b*) are views showing variations of the sealing plate shown in FIG. 8.
Figure 10:
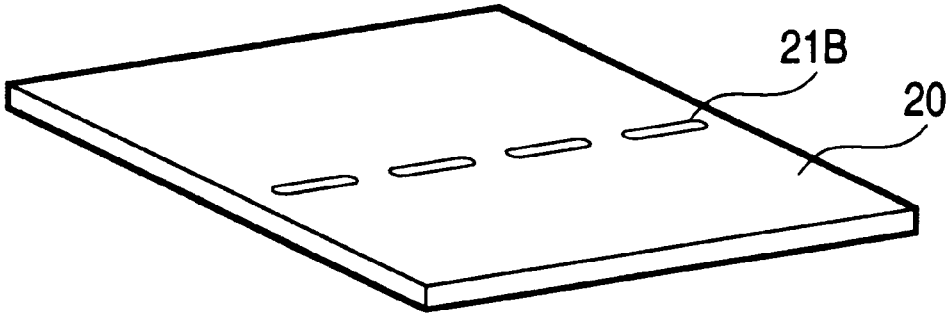

On the sealing plate 20, there are formed ink feed communicating ports 21 corresponding to the pressure generating chambers 12. For example, the sealing plate 20 is made of glass ceramic, the thickness of which is 0.1 to 1 mm and the coefficient of linear expansion of which is 2.5 to 4.5 ($10^{-6}$/°C.). In this connection, as shown in FIGS. 10(*a*) and 10(*b*), the ink feed communicating port 21 may be one slit-shaped hole 21A which crosses a portion close to the end portion of each pressure generating chamber 12 on the ink feed side, or alternatively the ink feed communicating port 21 may be a plurality of slit-shaped holes 21B. One surface of the sealing plate 20 covers the overall surface of the passage forming base plate 10, so that the sealing plate 20 functions as a protective plate for protecting the single crystal silicon base plate from a force given from the outside of the recording head. Also, the other surface of the sealing plate 20 composes a wall surface of the common ink chamber 31.

The common ink chamber forming base plate 30 composes a circumferential wall of the common ink chamber 31. The thickness of the common ink chamber forming base plate 30 is determined in accordance with the number of nozzle openings and the ink drop jetting frequency. This common ink chamber forming base plate 30 is made by punching a stainless steel plate of appropriate thickness. In this embodiment, the thickness of the common ink chamber forming base plate 30 is 0.2 mm.

The ink chamber side plate 40 is composed of a stainless steel base plate. One surface of the ink chamber side plate 40 composes a wall surface of the common ink chamber 31. On the other surface of the ink chamber side plate 40, half-etching is conducted, so that a recess portion 40*a* is formed. In this way, a thin wall 41 is formed on the other surface of the ink chamber side plate 40. On the ink chamber side plate 40, there is formed an ink introducing port 42 by means of punching through which ink is supplied from the outside of the recording head. In this connection, the thin wall 41 is provided for absorbing pressure directed to the side opposite to the nozzle opening 111 which is generated in the case of jetting ink. Therefore, the thin wall 41 prevents an unnecessary positive or negative pressure from being given to other pressure generating chambers 12 via the common ink chamber 31. In this embodiment, consideration is given to the rigidity necessary for connecting the ink introducing port 42 with the ink supply means provided outside the recording head, and the thickness of the ink chamber side plate 40 is determined to be 0.2 mm, and one portion of the ink chamber side plate 40 is determined to be 0.02 mm so as to form a thin wall 41. However, in order to omit the formation of the thin wall 41 by means of etching, the thickness of the ink chamber side wall 40 may be determined to be 0.02 mm at the beginning. On the other hand, on the elastic film 50 on the side opposite to the opening surface of the passage forming base plate 10, there are provided a lower electrode film 60, the thickness of which is approximately 0.5 μm, a piezoelectric film 70, the thickness of which is approximately 1 μm, and an upper electrode film 80, the thickness of which is approximately 0.1 μm, which are laminated on each other in a process described later. In this way, the piezoelectric vibrator (piezoelectric element) is formed. In a region on this elastic film 50 opposed to each pressure generating chamber 12, there is provided an independent piezoelectric vibrator for each pressure generating chamber 12. In this embodiment, the lower electrode film 60 functions as a common electrode of the piezoelectric vibrators, and the upper electrode film 80 functions as individual electrodes of the piezoelectric vibrators. However, for the convenience of the drive circuit or wiring, the circumstances may be reversed in such a manner that the upper electrode film 80 functions as a common electrode of the piezoelectric vibrators, and the lower electrode film 60 functions as individual electrodes of the piezoelectric vibrators. In this embodiment, the piezoelectric film 70 is individually provided corresponding to each pressure generating chamber 12. However, the piezoelectric film 70 may be provided on the overall surface, and the upper electrode film 80 may be individually provided corresponding to each pressure generating chamber 12. In any case described above, the piezoelectric active section is formed for each pressure generating chamber 12.

In this case, referring to FIG. 11, a process in which the piezoelectric film 70 and others are formed on the passage forming base plate 10 composed of a single crystal silicon base plate will be explained below.

Figure 11:
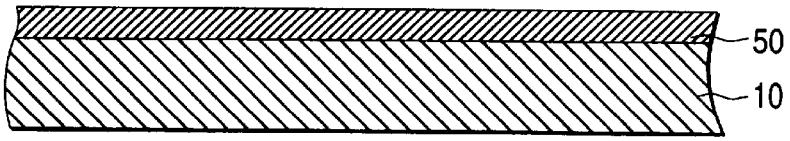
FIGS. 11(*a*)–(*d*) are views showing a thin film manufacturing process of Embodiment 2 of the present invention.
Figure 11:
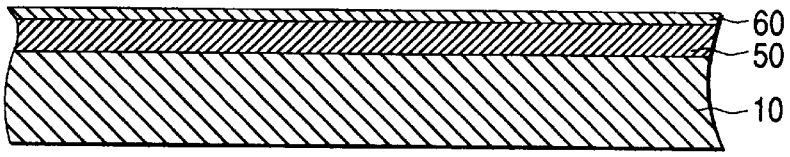
Figure 11:
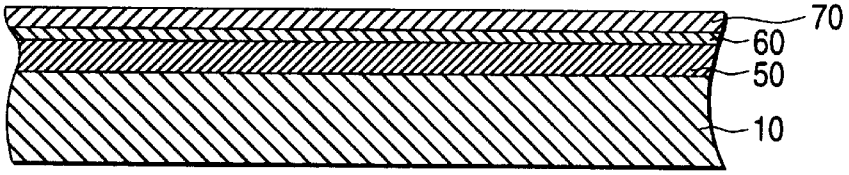
Figure 11:
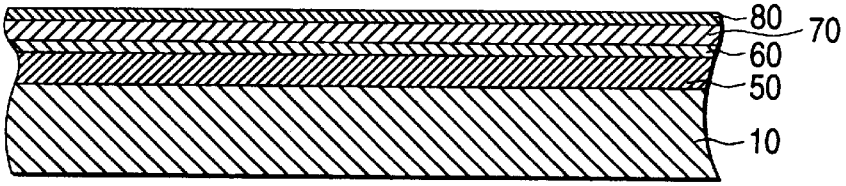

First, as shown in FIG. 11(*a*), there is provided a wafer made of a single crystal silicon base plate which is formed into a passage forming base plate 10. This wafer is thermally oxidized at 1100° C. in a diffusion furnace, so that an elastic film 50 of silicon dioxide is formed.

Next, as shown in FIG. 11(*b*), the lower electrode film 60 is formed by means of spattering. Concerning the material of the lower electrode film 60, Pt is preferably used. The reason why Pt is used for the material of the lower electrode film 60 is described as follows. The piezoelectric film 70 described later, which is formed by the process of spattering or the process of sol-gel, must be fired after the formation of film at the temperature of 600 to 1000° C. in the atmosphere or oxygen gas, so that the piezoelectric film 70 can be crystallized. That is, the material of the lower electrode film 70 must be electrically conductive in the oxidizing atmosphere of high temperature described above. Especially when PZT is used for the piezoelectric film 70, it is preferable that the conductivity is seldom changed by the diffusion of PbO. For the above reasons, Pt is preferably used.

Next, the piezoelectric film 70 is formed as shown in FIG. 11(*c*). When the piezoelectric film 70 is formed in this case, it is possible to use the process of spattering. However, in this embodiment, the process of sol-gel is used. In the process of sol-gel, sol in which a metallic organic matter is dissolved and dispersed in solvent is coated and dried, so that sol is changed into gel, and the thus obtained gel is fired at high temperature. In this way, the piezoelectric film 70 made of metallic oxide is obtained. When the piezoelectric film 70 is used for an ink jet type recording head, it is preferably made of lead zirconate titanate (PZT).

Next, as shown in FIG. 11(*d*), the upper electrode film 80 is formed. As long as the electric conductivity is high, any material may be used for the upper electrode film 80. Metal such as Al, Au, Ni or Pt can be used, and also electrically conductive oxide can be used. In this embodiment, the upper electrode film 80 is made of Pt by the process of spattering.

Figure 12:
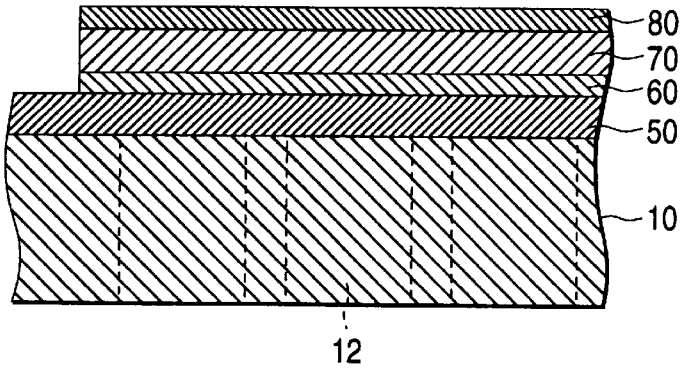
FIGS. 12(*a*)–(*c*) are views showing a thin film manufacturing process of Embodiment 2 of the present invention.
Figure 12:
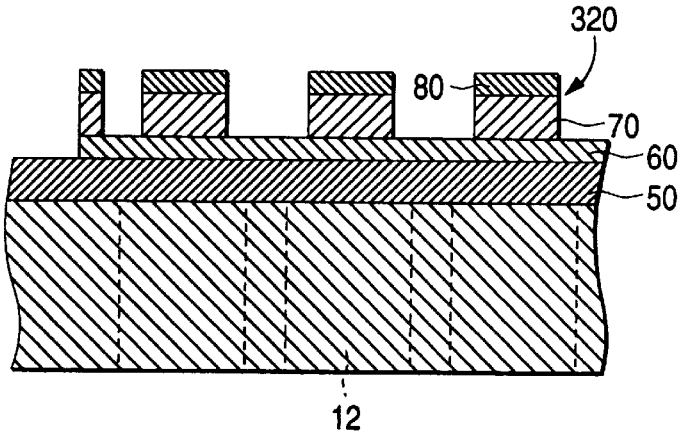
Figure 12:
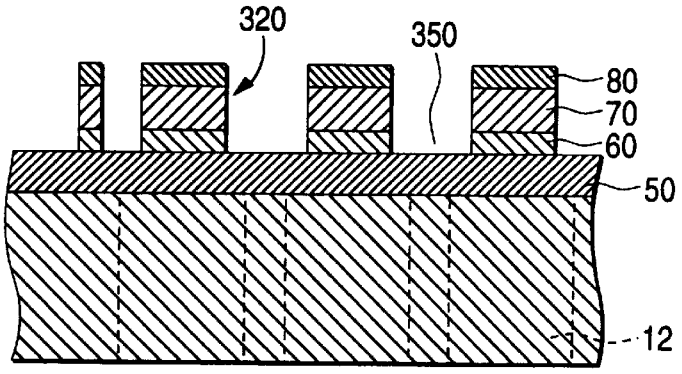

Next, as shown in FIGS. 12(*a*) to 12(*c*), patterning is conducted on the lower electrode film 60, piezoelectric film 70 and upper electrode film 80.

First, as shown in FIG. 12(*a*), the lower electrode film 60, piezoelectric film 70 and upper electrode film 80 are etched all together so that the overall pattern of the lower electrode 60 is formed. Next, as shown in FIG. 12(*b*), when only the piezoelectric film 70 and the upper electrode film 80 are etched, so that patterning can be conducted on the piezoelectric active section 320. Then, as shown in FIG. 12(*c*), a portion of the lower electrode 60 corresponding to an arm of the vibrating plate on both sides of the piezoelectric active section 320 is removed, wherein this portion is opposed to both sides in the width direction of each pressure generating chamber 12. Although the pressure generating chamber 12 has not been formed yet, it is shown by a broken line in FIG. 12. Due to the foregoing, the lower electrode film removing section 350 is formed. When the lower electrode film removing section 350 is formed in this way, an amount of displacement caused by impressing voltage upon the piezoelectric active section 320 can be increased.

In this connection, the entire lower electrode film 60 is not necessarily removed from the lower electrode film removing section 350, but the thickness of the lower electrode film may be reduced. The lower electrode film removing section 350 is formed in the portion corresponding to the arm section of the piezoelectric active section 320 in this embodiment. However, the present invention is not limited to the above specific embodiment. For example, the lower electrode film removing section 350 may be formed in a portion outside of both end portions in the longitudinal direction of the piezoelectric active section 320. Alternatively, it may be formed in the substantial overall peripheral edge portion of the pressure generating chamber. Of course, this lower electrode removing section 350 is not necessarily provided.

As described above, after the completion of patterning of the lower electrode film 60, an insulating layer 90 having an electrically insulating property is formed in such a manner that it covers at least the circumferential edge of the upper surface of each upper electrode film 80 and also covers the sides of the piezoelectric film 70 and the lower electrode film 60 (shown in FIG. 8). The insulating layer 90 is made of material from which a film can be formed by the film forming method or the etching method. Examples of the material of the insulating layer 90 are: silicon oxide, silicon nitride, and organic material. It is preferable that the insulating layer 90 is made of photosensitive polyimide, the rigidity of which is low and the electric insulating property of which is excellent.

In a portion of the upper surface of the insulating layer 90 corresponding to one end portion of each piezoelectric active section 320, there are formed contact holes 90*a* through which a portion of the upper electrode film 80 is exposed so that it can be connected with the lead electrode 100 described later. One end of the lead electrode 100 is connected with each upper electrode film 80 via this contact hole 90*a,* and the other end of the lead electrode 100 is connected with the connecting terminal section. The width of the lead electrode 100 is formed to be as narrow as possible so that a drive signal can be positively fed to the upper electrode film 80.

Figure 13:
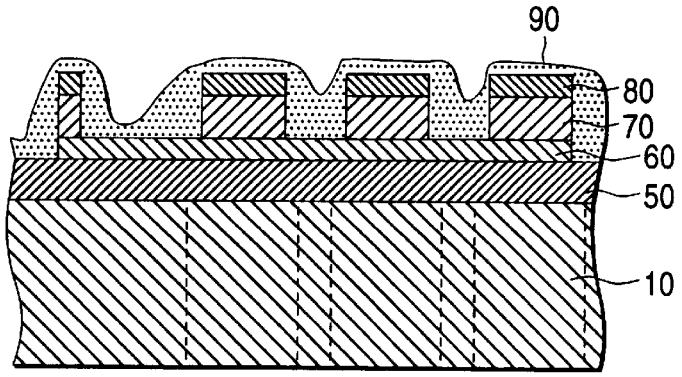
FIGS. 13(*a*)–(*c*) are views showing a thin film manufacturing process of Embodiment 2 of the present invention. Specifically FIGS. 13(*a*) and 13(*b*) are views taken along 13AB—13AB in FIG. 9(*b*) and FIG. 13(*c*) is taken along line 13C—13C in FIG. 9(*b*).
Figure 13:
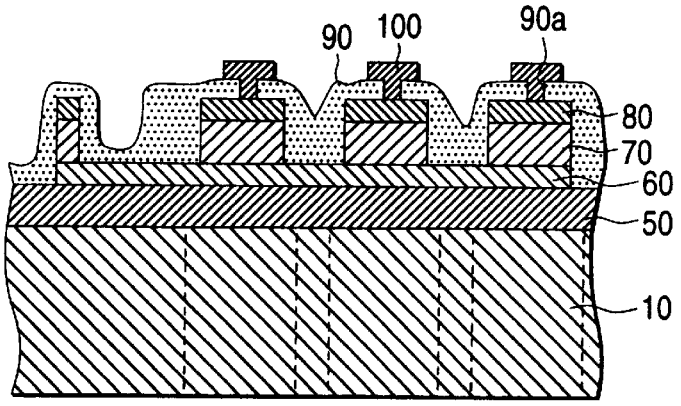
Figure 13:
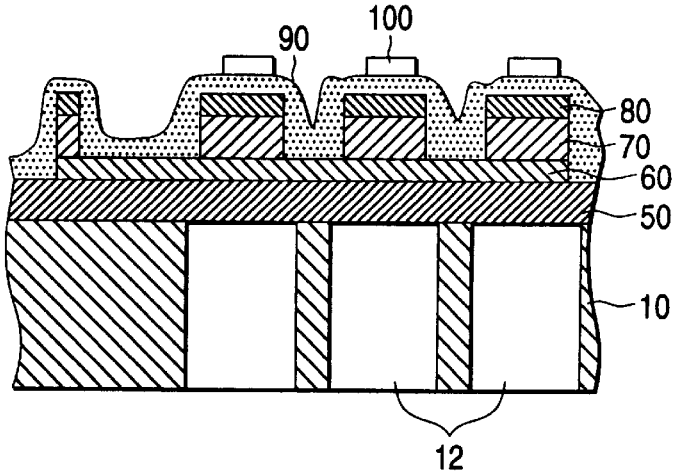

FIGS. 13(*a*) to 13(*c*) are views showing a forming process of the above insulating layer.

First, as shown in FIG. 13(*a*), the insulating layer 90 is formed by the following film forming process, so that the insulating layer 90 can cover the circumferential edge of the upper electrode layer 80 and the sides of the piezoelectric film 70 and the lower electrode film 60. Preferable materials of this insulating layer 90 are described above. In this embodiment, a negative type photosensitive polyimide is used.

Next, as shown in FIG. 13(*b*), patterning is conducted on the insulating layer 90, so that the contact hole 90*a* can be formed in a portion corresponding to an end portion outside of each pressure generating Chamber 12. For the convenience of explanation, FIG. 13(*b*) shows a cross-section of the contact hole 90*a* in a region opposed to the outer circumferential wall of the pressure generating chamber 12. In the present invention, the contact hole 90*a* connects the lead electrode 100 with the upper electrode film 80. Alternatively, the upper electrode film 80 may be extended to an end portion of the base plate, and it may be directly connected with a flexible cable. The contact hole 90*a* may be provided in a region opposed to the pressure generating chamber 12.

Next, after a conductive film of Cr-Au is formed on the overall surface, patterning is conducted, and the lead electrode 100 can be formed.

After film formation has been conducted in the manner described above, as shown in FIG. 13(*c*), anisotropic etching is conducted on the single crystal silicon base plate in the alkali solution described before, so that the pressure generating chamber 12 and others can be formed. According to a series of film formation and anisotropic etching explained above, a large number of chips are simultaneously formed on one wafer. After the process has been completed, the passage forming base plate 10 of one chip size is divided as shown in FIG. 8. The thus divided passage forming base plate 10 is successively made to adhere onto the sealing plate 20, common ink chamber forming base plate 30 and ink chamber side plate 40, so that these plates can be integrated into one body. In this way, the ink jet type recording head can be formed.

Ink drops are jetted out from the thus composed ink jet head as follows. Ink is fed from the ink introducing port 42 connected with an outside ink feed means not illustrated in the drawing. Members from the common ink chamber 31 to the nozzle opening 111 are filled with ink. After that, according to a recording signal sent from a drive circuit not shown in the drawing and provided outside, voltage is impressed between the lower electrode film 60 and the upper electrode film 80 via the lead electrode 100, so that the elastic film 50, lower electrode film 60 and piezoelectric film 70 are deflected. Due to the above deflection, pressure in the pressure generating chamber 12 can be increased and ink drops can be jetted out from the nozzle opening 111.

Figure 14:
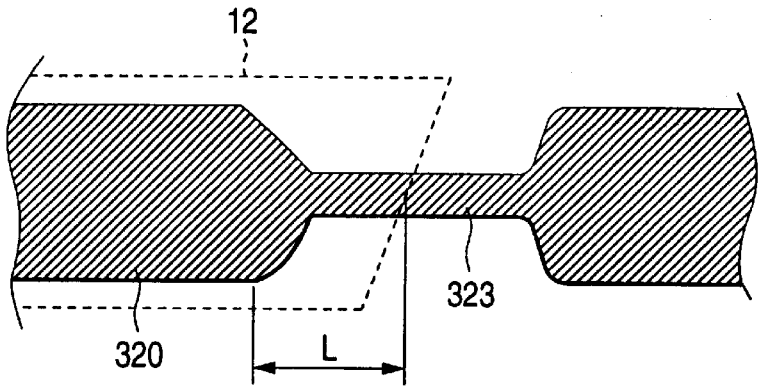
FIG. 14 is a plan view of a primary portion of Embodiment 2 of the present invention.

FIG. 14 is a view showing a positional relationship between the pressure generating chamber 12 and the piezoelectric active section 320 of the thus formed ink jet type recording head.

As shown in FIG. 14, the piezoelectric active section 320 composed of the piezoelectric film 70 and the upper electrode film 80 is essentially arranged in a region opposed to the pressure generating chamber 12, and the width of the piezoelectric active section 320 is a little smaller than the width of the pressure generating chamber 12. However, at one end portion of the pressure generating chamber 12, the piezoelectric active section 320 continuously extends through a narrow width section 323 which is arranged in a portion close to the connecting section crossing from a region opposed to the pressure generating chamber 12 to a region opposed to the circumferential wall. The width of the narrow width section 323 located in a portion close to the boundary between the pressure generating chamber 12 and the circumferential wall is smaller than the widths of other portions. In this connection, the narrow width section 323 of this embodiment is formed in such a manner that widths of both the piezoelectric film 70 and the upper electrode film 80 are reduced.

In this embodiment, the width of the pressure generating chamber 12 is 50 $\mu$m, the width of the piezoelectric active section 320 is 35 to 40 $\mu$m, and the width the piezoelectric layer 70 of the narrow width section 323 is 10 to 15 $\mu$m.

In the above arrangement, when the piezoelectric vibrator is driven, deflection is gradually caused in the pressure generating chamber 12 and on its circumferential wall. Accordingly, an intensity of stress of the narrow width section 323 can be reduced. As a result, the occurrence of cracks can be prevented and the durability can be enhanced.

In this connection, in order to provide the above effects, a distance L from an end portion of the narrow width section 323 on the pressure generating chamber 12 side, that is, from a position at which the width of the piezoelectric active section 320 starts decreasing, to a position at which the narrow width section 323 crosses a boundary of the circumferential wall, is preferably not less than ½ of the width of the pressure generating chamber 12.

Further, it is preferable to conduct patterning in such a manner that a corner portion close to the boundary between the primary portion of the piezoelectric active section 320 and the narrow width section 323 is formed into an R-section and the width is gradually changed.

Figure 15:
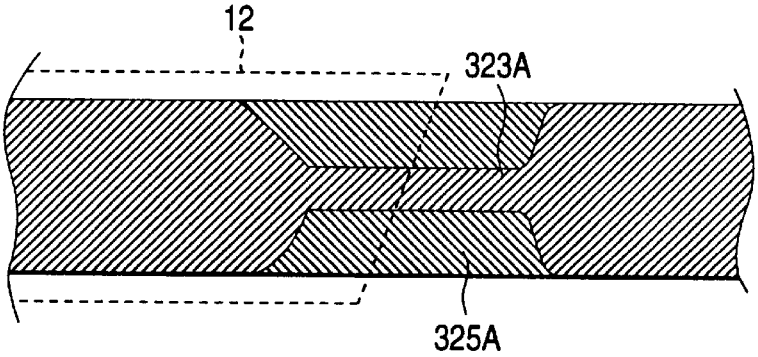
FIG. 15 is a plan view of a primary portion for explaining a variation of Embodiment 2 of the present invention.

FIG. 15 is a view showing a pattern of the piezoelectric active section close to the pressure generating chamber of the ink jet type recording head of a variation of Embodiment 2.

In this embodiment, the narrow width section 323A of the piezoelectric active section 320 is formed when the width of the upper electrode film 80 is reduced, and an inactive section (inert section) 325A composed of the piezoelectric film 70 having no upper electrode film 80 is provided on both sides of the narrow width section 323A. Other points are the same as those of Embodiment 1.

According to the above arrangement, deflection caused in the narrow width section 323A can be suppressed, so that damage caused by cracks can be prevented and the durability can be enhanced.

Figure 16:
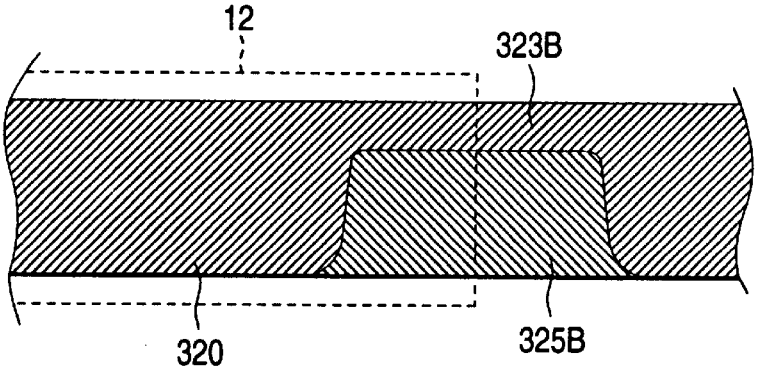
FIG. 16 is a plan view of a primary portion for explaining another variation of Embodiment 2 of the present invention.

FIG. 16 is a view showing a pattern of the piezoelectric active section close to the pressure generating chamber of the ink jet type recording head of another variation of Embodiment 2.

In this embodiment, the narrow width section 323B is formed in such a manner that the width of the piezoelectric active section 320 is reduced when it is biased onto one side wall of the pressure generating chamber 12. Due to the above arrangement, when voltage is impressed, the deflection of the narrow width section 323B at the end of the pressure generating chamber 12 becomes smaller than the deflection in the case where the connecting section is located at the center. In the narrow width section 323B, only the width of the upper electrode film 80 is reduced, and the inactive section 325B is provided on one side of the narrow width section 323B. Of course, the piezoelectric film 70 of the inactive section 325B may be removed.

Figure 17:
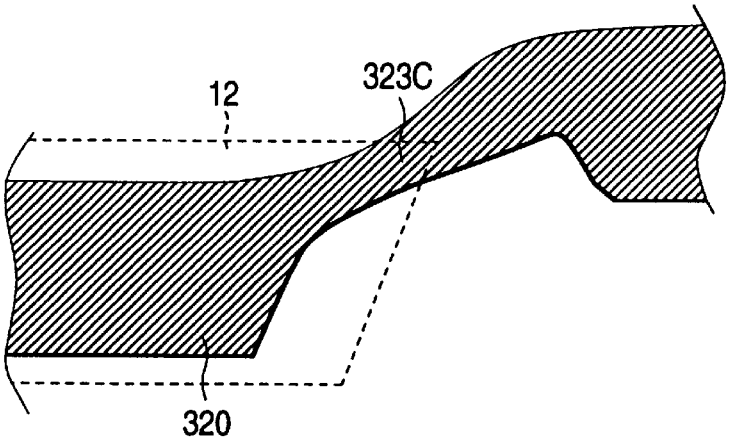
FIG. 17 is a plan view of a primary portion for explaining still another variation of Embodiment 2 of the present invention.

FIG. 17 is a view showing a pattern of the piezoelectric active section close to the pressure generating chamber of the ink jet type recording head of still another variation of Embodiment 2.

In this embodiment, the narrow width section 323C is formed in such a manner that the piezoelectric active section 320 is biased onto one side wall of the pressure generating chamber 12. Due to the above arrangement, when voltage is impressed, the deflection of the narrow width section 323C at the end of the pressure generating chamber 12 becomes smaller than the deflection in the case where the connecting section is located at the center. In the narrow width section 323C, the widths of the upper electrode film 80 and the piezoelectric film 70 are reduced.

When the narrow width section 323C is arranged at a corner portion, especially when the narrow width section 323C is arranged above a corner portion, the angle of which is acute, deflection is seldom caused, and the occurrence of cracks can be prevented.

Figure 18:
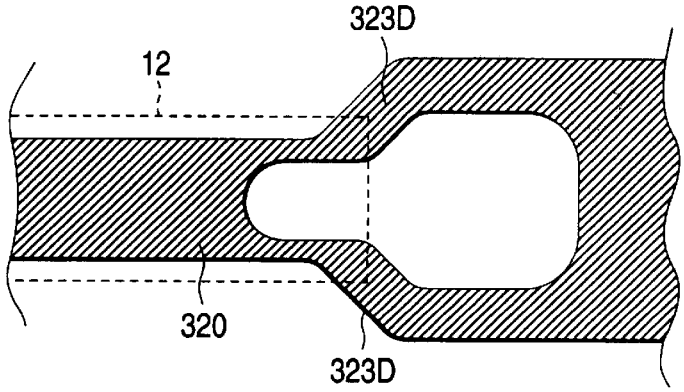
FIG. 18 is a plan view of a primary portion for explaining still another variation of Embodiment 2 of the present invention.

FIG. 18 is a view showing a pattern of the piezoelectric active section close to the pressure generating chamber of the ink jet type recording head of still another variation of Embodiment 2.

In this embodiment, two narrow width sections 323D are arranged in the regions opposed to two corner portions of the pressure generating chamber 12. Other points are the same as those of the embodiment shown in FIG. 17. Accordingly, the piezoelectric film 70 and the upper electrode film 80 are removed from between the two narrow width sections 323D. In this connection, the effects of this embodiment are substantially the same as those of the embodiment shown in FIG. 17.

Figure 19:
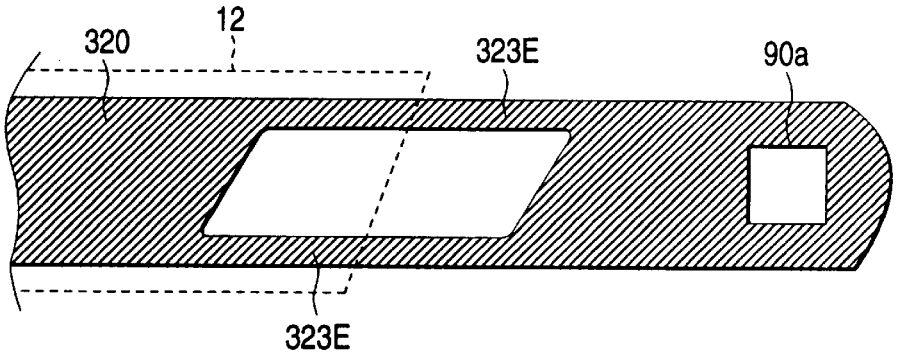
FIG. 19 is a plan view of a primary portion for explaining still another variation of Embodiment 2 of the present invention.

FIG. 19 is a view showing a pattern of the piezoelectric active section close to the pressure generating chamber of the ink jet type recording head of still another variation of Embodiment 2.

In this embodiment, the narrow width sections 323E are arranged in portions opposed to each other close to the two corner portions of the pressure generating chamber 12. Other points are the same as those of the embodiment shown in FIG. 17. Accordingly, the piezoelectric film 70 and the upper electrode film 80 are removed from between the narrow width sections 323E. In this connection, the effects of this embodiment are substantially the same as those of the embodiment shown in FIG. 17. In this connection, [when] the contact hole 90*a* is not formed in a region opposed to the pressure generating chamber 12, but it is formed outside the region. Therefore, it is possible to prevent the occurrence of cracks in a portion close to the contact hole 90*a*. In each embodiment described before, it is possible to form the contact hole 90*a* outside the region opposed to the pressure generating chamber 12. In this case, in order to facilitate the impression of voltage, it is preferable that two or more narrow width connecting sections are formed like the embodiments shown in FIGS. 18 and 19.

EMBODIMENT 3

Figure 20:
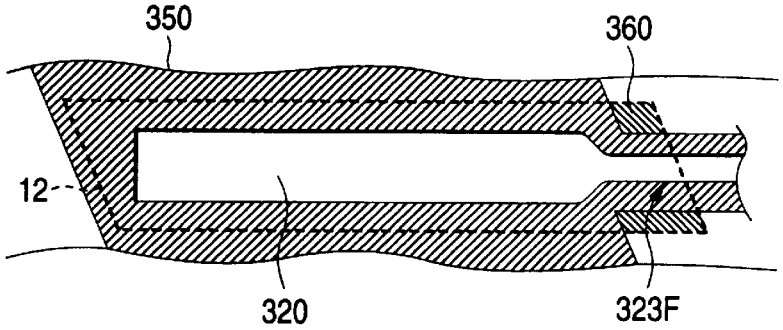
FIG. 20 is a plan view of a primary portion of Embodiment 3 of the present invention.

FIG. 20 is a plan view showing a primary portion of the ink jet type recording head of Embodiment 3. The essential structure of the ink jet type recording head of this embodiment is the same as that of Embodiment 2. Therefore, like reference characters are used to indicate like parts.

In this embodiment, the piezoelectric active section 320 is essentially located in a region opposed to the pressure generating chamber 12, and the lower electrode removing section 350 is formed in its periphery. The piezoelectric active section 320 is extended via the narrow width section 323F to a region opposed to the circumferential wall at the end portion in the longitudinal direction of the pressure generating chamber 12. Although the above structure is the same as that of Embodiment 2 described before, there are provided thick film sections 360 on both sides of the narrow width section 323F in the width direction in this embodiment. The thick film sections 360 are regions arranged on both sides of the narrow width section 323F in the width direction and opposed to the inside of the boundary between the pressure generating chamber 12 and the circumferential wall. The thick film section 360 may be thicker than the lower electrode film removing section 350. In this embodiment, the thick film section 360 is formed when the lower electrode film 60 is not removed. That is, the thick film section 360 is formed when the lower electrode film 60 is left as it is. Further, when the thick film section 360 is formed, the piezoelectric film 70 and the upper electrode film 80 may be left as they are. Furthermore, the insulating layer and other layers may be laminated.

Due to the above arrangement, the displacement caused by the deflection of the narrow width section 323F is further restricted when it is driven. A portion of the vibrating plate opposed to the inside of the boundary between the pressure generating chamber 12 and the circumferential wall is protected by the thick film section 360. Therefore, the durability of the vibrating plate can be enhanced.

Figure 21:
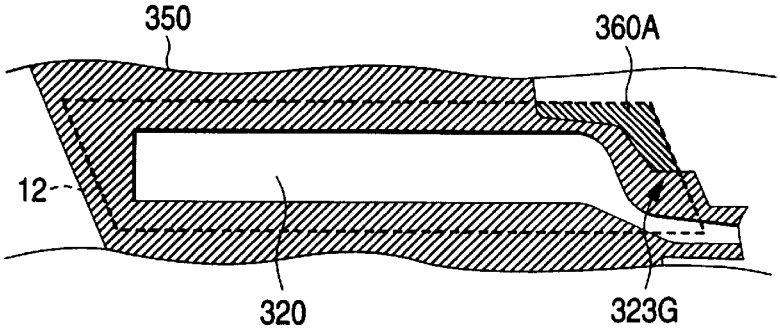
FIG. 21 is a plan view of a primary portion for explaining a variation of Embodiment 3 of the present invention.

FIG. 21 is a view showing a variation of Embodiment 3. In this embodiment, the narrow width section 323G is formed in such a manner that it crosses a region opposed to one corner of the pressure generating chamber 12. The thick film section 360A is arranged on the inside of the boundary of the other corner of the pressure generating chamber 12. Therefore, the same effect can be provided.

EMBODIMENT 4

Figure 22:
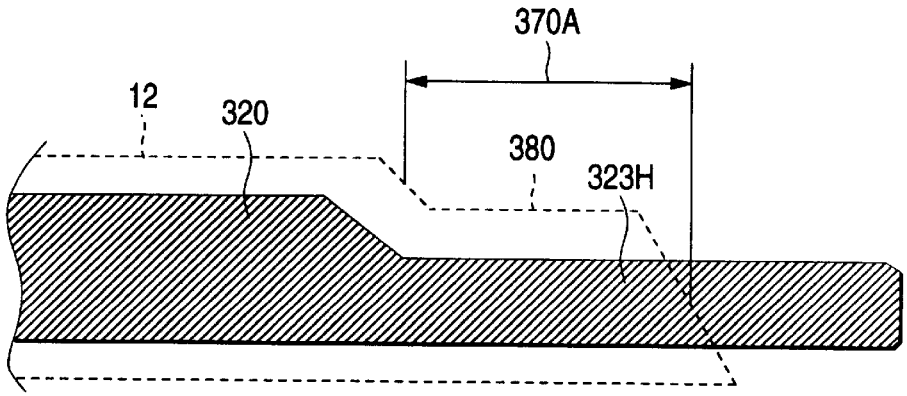
FIG. 22 is a plan view of a primary portion for explaining Embodiment 4 of the present invention.

FIG. 22 is a view showing a pattern of the piezoelectric active section arranged close to the pressure generating chamber of the ink jet type recording head of Embodiment 4 of the present invention. The essential structure of this embodiment is the same as that of Embodiment 2, and like reference characters are used to indicate like parts.

In this embodiment, there is provided a narrow width section 380 at one end portion of the pressure generating chamber 12 corresponding to the narrow width section 323H of the piezoelectric active section 320. This narrow width section 380 is a vibration restricting section 370A. The piezoelectric active section 320 is extended from an end portion corresponding to the vibration restricting section 370A to the circumferential wall.

Due to the above arrangement, the occurrence of cracks can be prevented and the durability can be enhanced as follows. When voltage is impressed upon the piezoelectric active section 320, in the vibration restricting section 370A which is a narrow width section 380 of the pressure generating chamber 12, the piezoelectric active section 320 is formed into the narrow width section 323H as described above. Therefore, the displacement is restricted in the case of driving, and further when the width of the pressure generating chamber 12 is reduced, the displacement can be further restricted. Therefore, the displacement can be reduced to be smaller than the displacement of other sections, and the deflection is gradually caused from the circumferential wall boundary toward the pressure generating chamber 12. Therefore, an intensity of stress in the piezoelectric active section 320 located in the vibration restricting section 370A is decreased. Accordingly, the occurrence of cracks can be prevented and the durability can be enhanced.

In this connection, in this embodiment, the width of the piezoelectric active section 320 in the narrow width section 380 is reduced. However, it should be noted that the width of the piezoelectric active section 320 is not necessarily reduced. When the width of the pressure generating chamber 12 is reduced as described above, the number of corners of the piezoelectric film 70 at which cracks tend to occur can be decreased by forming one of the side portions into a linear shape. Therefore, the durability can be further enhanced.

In the above embodiment in which the narrow width section is formed in the pressure generating chamber 12 so that the vibration restricting section can be formed, the lower electrode removing section may be arranged. In this case, the lower electrode removing section may be arranged in the entire sections including the vibration restricting section. Otherwise, the lower electrode removing section may be arranged in the sections except for the vibration restricting section.

In this connection, the contact hole is formed at a position opposed to the pressure generating chamber 12.

Figure 23:
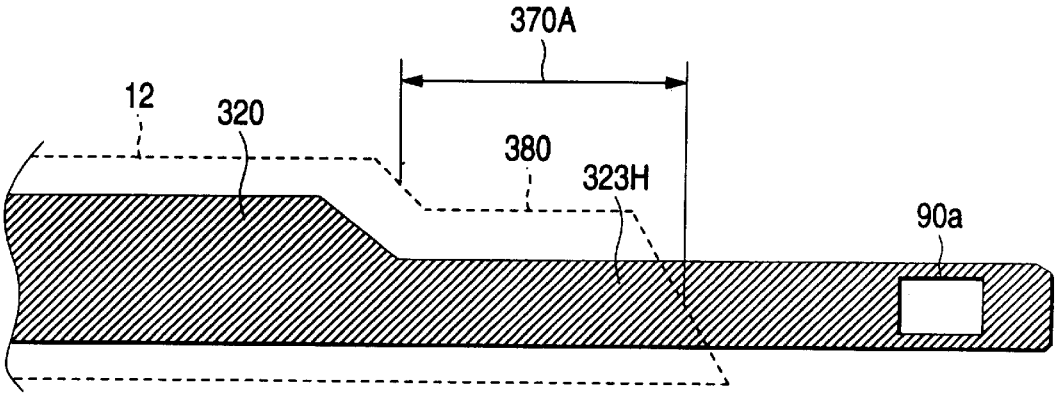
FIG. 23 is a plan view of a primary portion for explaining a variation of Embodiment 4 of the present invention.

FIG. 23 is a view showing a pattern of the piezoelectric active section arranged close to the pressure generating chamber of the ink jet type recording head of a variation of Embodiment 4.

In this embodiment, the contact hole 90*a* is formed in a portion opposed to the circumferential wall of the pressure generating chamber 12, and other points are the same as those of the embodiment described above. In this case, no substantial displacement is caused in the periphery of the contact hole 90*a*. Therefore, cracks are seldom caused in this portion.

Figure 24:
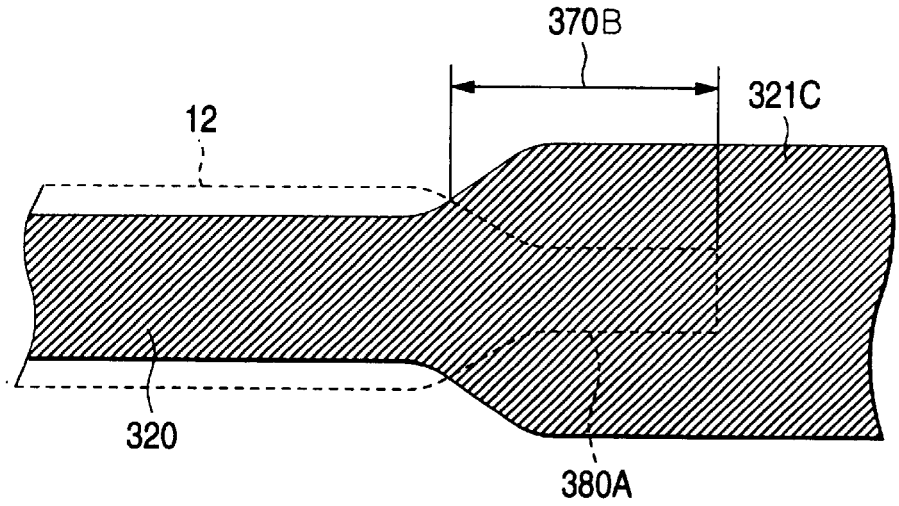
FIG. 24 is a plan view of a primary portion for explaining another variation of Embodiment 4 of the present invention.

FIG. 24 is a view showing a pattern of the piezoelectric active section arranged close to the pressure generating chamber of the ink jet type recording head of a variation of Embodiment 4.

In this embodiment, there is provided a narrow width section 380A at one end portion of the pressure generating chamber 12, and a portion of the piezoelectric active section 320 corresponding to the narrow width section 380A is made to be a wide width section 321C so that it can be formed into a vibration restricting section 370B. The displacement of this portion is smaller than that of other portions, and the deflection is gradually caused from the circumferential wall boundary to the pressure generating chamber 12. Accordingly, an intensity of stress of the piezoelectric active section 320 located in the vibration restricting section 370B is decreased. Therefore, the occurrence of cracks can be prevented and the durability can be enhanced.

In this connection, the narrow width section 380A of the pressure generating chamber 12 is formed in such a manner that the width is gradually reduced from both sides in the width direction so that the edge profile is formed into a curve. Also, the wide width section 321C of the piezoelectric active section 320 is formed in such a manner that the width of the piezoelectric active section 320 is gradually extended onto both sides in the width direction. Due to the foregoing, the number of corners of the piezoelectric film 70 in which cracks tend to occur can be suppressed. Accordingly, the durability can be further enhanced.

Figure 25:
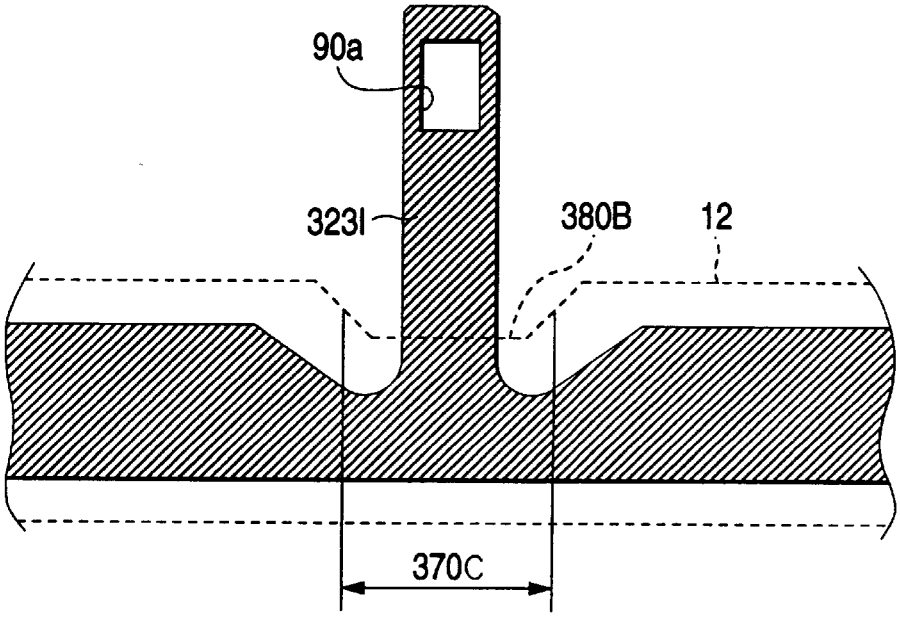
FIG. 25 is a plan view of a primary portion for explaining still another variation of Embodiment 4 of the present invention.

FIG. 25 is a view showing a pattern of the piezoelectric active section arranged close to the pressure generating chamber of the ink jet type recording head of a variation of Embodiment 4.

In this embodiment, the narrow width section 380B is arranged in portions except for the end portion of the pressure generating chamber 12 in the longitudinal direction, so that the narrow width section 380B can become a vibration restricting section 370C. Other points are the same as those of the embodiment described before.

Accordingly, in the vibration restricting section 370B, the narrow width section 323I of the piezoelectric active section 320 is formed on the side circumferential wall of the pressure generating chamber 12, and the contact hole 90*a* is formed in the narrow width section 323I.

In the above arrangement, vibration of the vibration restricting section 370B is restricted, and the narrow width section 323I is extended onto the circumferential wall in this portion. Accordingly, cracks are seldom caused in the narrow width section 323I.

The connecting section of the piezoelectric active section 320 extending in the width direction of the pressure generating chamber 12 is not limited to a case in which the vibration restricting section is arranged in a portion except for the end portion of the pressure generating chamber 12. Even in a case in which the vibration restricting section is arranged in the end portion like each embodiment described above, the connecting section extending to the side may be arranged.

OTHER EMBODIMENTS

Embodiments of the present invention are explained above, however, it should be noted that the essential structure of the ink jet type recording head of the invention is not limited to the above specific embodiments.

For example, not only the sealing plate 20 described before but also the common ink chamber plate 30 may be made of glass ceramic. Further, the thin film (wall) 41 may be a different member and made of glass ceramic, that is, the material and structure may be freely changed.

In the above embodiment, the nozzle opening is formed on an end surface of the passage forming base plate 10, however, it is possible to provide a nozzle opening protruding in a direction perpendicular to the surface.

Figure 26:
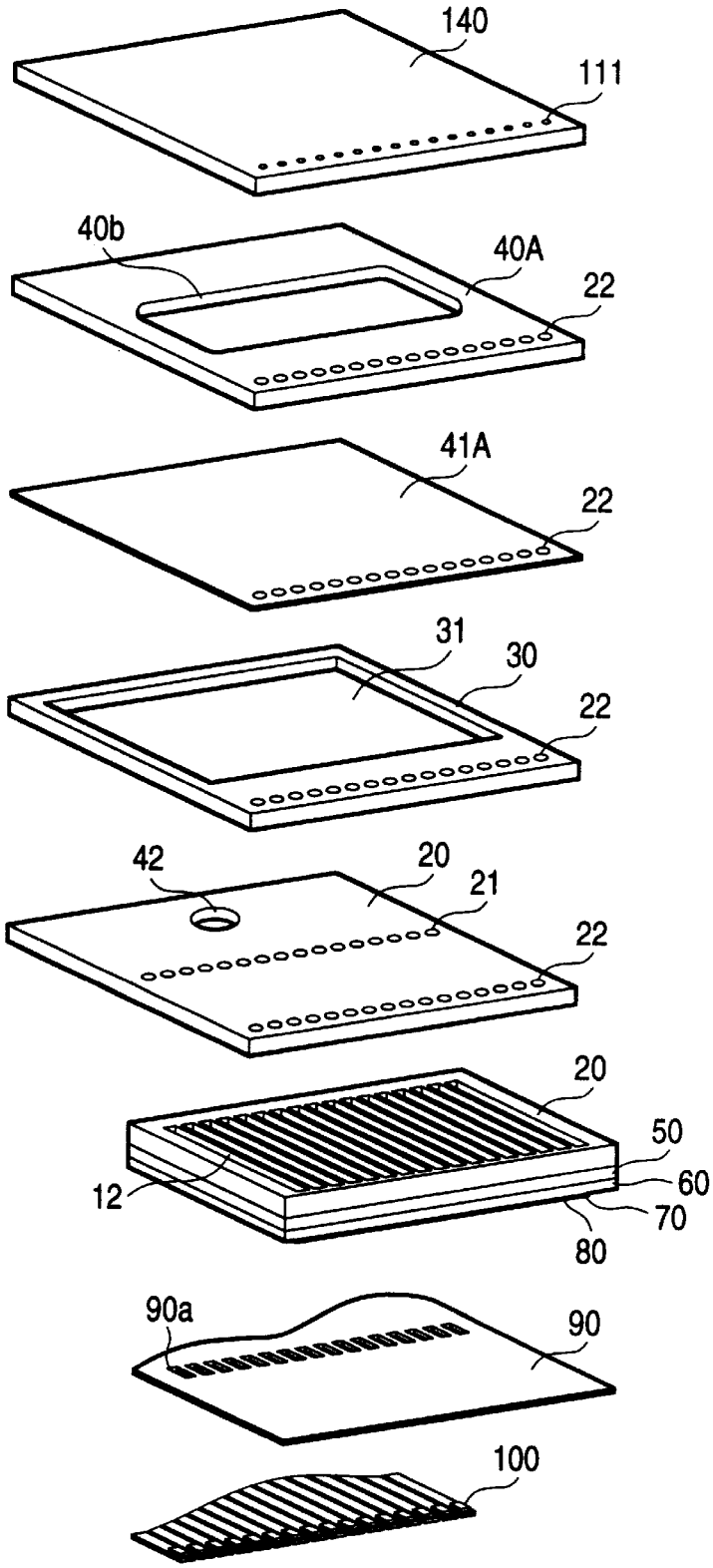
FIG. 26 is an exploded perspective view of the ink jet type recording head of another Embodiment of the present invention.
Figure 27:
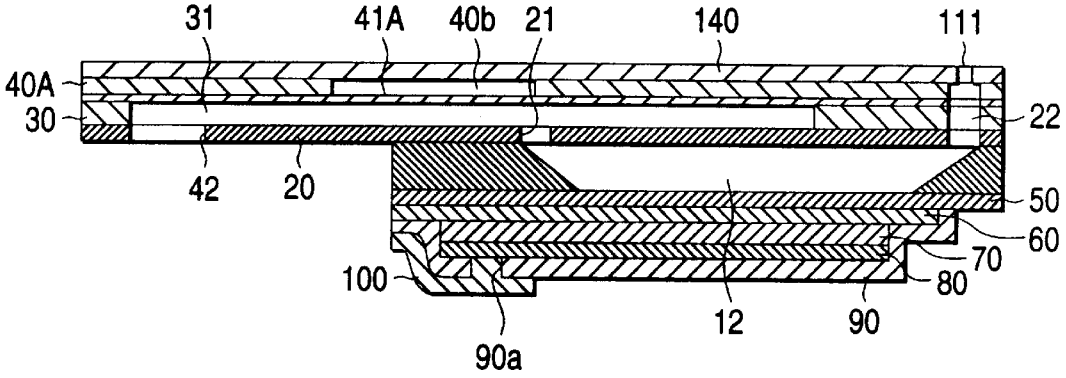
FIG. 27 is across-sectional view of the ink jet type recording head of another Embodiment of the present invention taken across a center portion of one of the pressure generating chambers 12 in FIG. 26.

FIG. 26 is an exploded perspective view of the embodiment composed as described above. FIG. 27 is a cross-sectional view of the passage. In this embodiment, the nozzle openings 111 are formed on the nozzle base plate 140 opposite to the piezoelectric vibrator. The nozzle communicating ports 22 to communicate these nozzle openings 111 with the pressure generating chambers 12 are formed penetrating the sealing plate 20, common ink chamber forming plate 30, thin plate 41A and ink chamber side plate 40A.

In this embodiment, the thin plate 41A and the ink chamber side plate 40A are made to be different members, and the opening 40*b* is formed on the ink chamber side plate 40. Other points are essentially the same as those of the embodiments described before. Like reference characters are used to indicate like parts, and the same explanations are omitted here. In the same manner as that of each embodiment described before, in this embodiment, it is possible to provide a vibration restricting section so as to restrict the vibration generated by the piezoelectric active section, so that the occurrence of cracks caused in a portion close to the boundary of the circumferential edge of the pressure generating chamber can be prevented.

Of course, the present invention can be applied to an ink jet type recording head in which the common ink chamber is formed on the passage forming base plate.

In each embodiment described before, the present invention is applied to an ink jet type recording head of thin film type manufactured by the process of film formation or the process of lithography. However, it should be noted that the present invention is not limited to the above specific embodiment. For example, the present invention can be applied to various types of ink jet recording heads such as an ink jet recording head in which the base plates are laminated so as to form pressure chambers, an ink jet recording head in which the piezoelectric film is formed by the process of adhering green sheets or the process of screen printing, and an ink jet recording head in which the piezoelectric film is formed by the growth of crystals.

In each embodiment described above, the vibrating plate is composed of an elastic film which is provided differently from the lower electrode film. However, the lower electrode film may be also used as an elastic film.

In the above embodiment, there is provided an insulating layer between the piezoelectric vibrator and the lead electrode. However, the present invention is not limited to the above specific embodiment. For example, the following arrangements may be adopted. There is provided no insulating layer, and an anisotropic conductive film is thermally deposited on each upper electrode, and this anisotropic conductive film is connected with the lead electrode. Alternatively, connection may be conducted by using various bonding technique such as wire bonding.

In the above embodiment, the upper electrode film 80 is made of Pt. However, when the piezoelectric layer 70 is made of PZT, it is preferable to use electrically conductive oxide instead of Pt. The reason is that Pt takes oxygen from PZT, so that the piezoelectric characteristic is deteriorated when oxygen is absorbed by Pt. In this case, when the upper electrode film 80 is formed, electrically conductive oxide material may be used. Also, it is possible to use an electrically conductive material. In this case, after the film of the conductive material is formed on the piezoelectric layer 70, an electrically conductive oxide film is formed on the interface. Examples of usable conductive oxide materials are: TiO, $Ti_2O_3$, $Ti_3O_5$, $Ti_4O_7$, $Ti_5O_9$, $Ti_6O_{11}$, $Ti_7O_{13}$, $Ti_8O_{15}$, $Ti_9O_{17}$, VO, $VO_2$, $V_2O_3$, $V_3O_5$, $V_4O_7$, $V_5O_9$, $V_6O_{11}$, $V_7O_{13}$, $V_8O_{15}$, $SnO_{2-x}$ wherein $0 \leqq x<2$ in the above composition formula, NbO, $NbO_2$, LaO, SmO, NdO, $Fe_3O_4$, $ReO_3$, $ReO_2$, $Rh_2O_3$, $RhO_2$, $CrO_2$, $MoO_2$, $WO_2$, $RuO_2$, $OsO_2$, $IrO_2$, $PtO_2$, $LiTi_2O_4$, $LiV_2O_4$, $K_2P_8W_{32}O_{112}$, $Rb_2P_8W_{32}O_{112}$, $Tl_2P_8W_{32}O_{112}$, $LaTiO_3$, $CeTiO_3$, $CaVO_3$, $SrO_3$, $La_{1-x}Sr_xVO_3$ wherein $0.23<x<1$ in the above composition formula, $La_4BaCu5O_{13-y}$, $LaSrCu_6O_{15}$, $La_2SrCu_2O_{62}$, $Gd_{1-x}Sr_xVO_3$ wherein $0.4 \leqq x \leqq 0.45$ in the above composition formula, $CaCrO_3$, $SrCrO_3$, $La_{1-x}Sr_xMrO_3$ wherein $0.2<x<0.4$ in the above composition formula, $SrFeO_3$, $SrCoO_3$, $LaCoO_3$, $La_{1-x}Sr_xCoO_3$ wherein $0<x<1$ in the above composition formula, $LaNiO_3$, $LaCuO_3$, $EuNbO_3$, $Nb_{12}O_{29}$, $CaRuO_3$, $SrRuO_3$, $Ca_{1-x}Sr_xRuO_3$ wherein $0<x<1$ in the above composition formula, $BaRuO_3$, $Ba_{1-x}K_xRuO_3$ wherein $0<x<1$ in the above composition formula, $La_{0.5}Na_{0.5}RuO_3$, $SrIrO_3$, $BaPbO_3$, $Ba_{1-x}Sr_xPbO_{3-y}$ wherein $0<x<0.5$ and $0<y<1$ in the above composition formula, $BaPb_{1-x}Bi_xO_3$ wherein $0<x<1$ in the above composition formula, $Ba_{1-x}K_xBiO_3$ wherein $0<x<1$ in the above composition formula, $BaPb_{0.75}Sb_{0.25}O3$, $CaMoO_3$, $SrMoO_3$, $BaMoO_3$, $(Ba,Ca,Sr)TiO_{3-x}$ wherein $0<x<1$ in the above composition formula, $La_4Re_6O_{19}$, $La_4Ru_6O_{19}$, $Bi_3RU_3O_{11}$, $La_3Ni_2O_7$, $La_4Ni_3O_{10}$, $Nd_2NiO_4$, $La_2CuO_4$, $Sr_2RuO_4$, $Nd_2Mo_2O_{7-y}$ wherein $0<y<1$ in the above composition formula, $Sm_2Mo_2O_{7-y}$ wherein $0<y<1$ in the above composition formula, $Gd_2Mo_2O_{7-y}$ wherein $0<y<1$ in the above composition formula, $Pb_2Tc_2O_{7-y}$ wherein $0<y<1$ in the above composition formula, $Tl_2Ru_2O_{7-y}$ wherein $0<y<1$ in the above composition formula, $Pb_2Ru_2O_{7-y}$ wherein $0<y<1$ in the above composition formula, $Bi_2Ru_2O_{7-y}$ wherein $0<y<1$ in the above composition formula, $Lu_2Ru_2O_{7-y}$ wherein $0<y<1$ in the above composition formula, $Tl_2Rh_2O_{7-y}$ wherein $0<y<1$ in the above composition formula, $Bi_2Rh_2O_{7-y}$ wherein $0<y<1$ in the above composition formula, $Pb_2Re_2O_{7-y}$ wherein $0<y<1$ in the above composition formula, $Cd_2Re_2O_{7-y}$ wherein $0<y<1$ in the above composition formula, $Tl_2Os_2O_{7-y}$ wherein $0< y<1$ in the above composition formula, $Pb_2Os_2O_{7-y}$ wherein $0<y<1$ in the above composition formula, $Ln_2Os_2O_{7-y}$ wherein $0<y<1$ in the above composition formula, $Tl_2Ir_2O_{7-y}$ wherein $0<y<1$ in the above composition formula, $Pb_2Ir_2O_{7-y}$ wherein $0<y<1$ in the above composition formula, $Bi_2Ir_2O_{7-y}$ wherein $0<y<1$ in the above composition formula, $Lu_2Ir_2O_{7-y}$ wherein $0<y<1$ in the above composition formula, $Li_2RuO_3$, $Cu_6O_8ScCl$, $Cu_6O_8InCl$, $Pd_{1-x}Li_xO$ wherein $0.01<x<1$ in the above composition formula, $Cu_xV_2O_5$ wherein $0<x<1$ in the above composition formula, $Na_2V_2O_5$, $K_{0.3}MoO_3$, $Rb_{0.3}MoO_3$, $Tl_{0.3}MoO_3$, $Mo_{17}O_{47}$, $Tl_2O_{3-y}$ wherein $0<y<1$ in the above composition formula, and $TlO_{1-y}F$ wherein $0<y<1$ in the above composition formula. Examples of usable conductive materials are Ir, Pd, Rb and Ru. When the upper electrode 80 is made of the above materials, the layer of $IrO_x$, $PdO_x$, $RbO_x$ or $RuO_x$ is formed on the piezoelectric layer 70 and the interface, and the same effect can be provided. Of course, the conductive film of Pt may be laminated on the layer made of the above materials so as to form an upper electrode film 80.

As described above, it is possible to apply the present invention to various types of ink jet recording heads as long as it is in the scope of claim of the present invention.

Therefore, in the present invention, there is provided a vibration regulating section in which vibration caused by the impression of voltage is relatively regulated, and the piezoelectric active section is extended onto the circumferential wall by this vibration regulating section. Therefore, deflection in this portion can be reduced as compared with that of other portions. Accordingly, the occurrence of cracks can be prevented and the durability can be enhanced.

What is claimed is:

1. An ink jet type recording head comprising:

a piezoelectric vibrator including:

a vibrating plate composing a portion of a pressure generating chamber communicated with a nozzle opening;

a lower electrode;

a piezoelectric layer formed on the lower electrode; and an upper electrode formed on the piezoelectric layer in a piezoelectric active section opposed to the pressure generating chamber;

wherein the piezoelectric active section has a connecting section that is situated on a circumferential region defining the pressure generating chamber; and wherein the piezoelectric active section has a vibration regulating section for regulating a vibrating movement of the vibrating plate.

2. An ink jet type recording-head according to claim 1, wherein the vibrating plate has a thin wall section, a thickness of which is thinner than a thickness of a portion corresponding to the piezoelectric active section, on both sides of the piezoelectric active section in a width direction.

3. An ink jet type recording-head according to claim 1, wherein the vibration regulating section is composed of a wide width section in which the piezoelectric layer is wider than a primary portion of the piezoelectric active section, and the wide width section is extended to a side wall and arranged on one end side-of the pressure generating chamber in a longitudinal direction.

4. An ink jet type recording head according to claim 3, wherein the upper electrode is arranged on the piezoelectric layer of the vibration regulating section.

5. An ink jet type recording head according to claim 3, wherein the upper electrode is removed from at least one portion of the piezoelectric layer of the vibration regulating section.

6. An ink jet type recording head according to claim 5, wherein inactive sections are formed in said one portion.

7. An ink jet type recording head according to claim 3, wherein a width of the piezoelectric layer is gradually changed from the primary portion of the piezoelectric active section to the wide width section.

8. An ink jet type recording head according to claim 1, wherein the vibration regulating section is formed by changing a relative relation between a width of the pressure generating chamber and a width of a primary portion of the piezoelectric active section.

9. An ink jet type recording head according to claim 8, wherein the vibration regulating section is composed of a narrow width section in which both the width of the piezoelectric layer close to the connecting section and a width of the upper electrode are reduced.

10. An ink jet type recording head according to claim 7, wherein the vibration regulating section is composed of a narrow width section in which only a width of the upper electrode of the piezoelectric active section close to the connecting section is reduced.

11. An ink jet type recording head according to claim 7 wherein the width of the piezoelectric active section is gradually changed from the primary section to a narrow width section.

12. An ink jet type recording head according to claim 9, wherein a thick film section, an entire film thickness of which is larger than an entire film thickness in a periphery of the piezoelectric active section, is arranged at least in a portion of an inner edge of the boundary between the pressure generating chamber and the circumferential region on both sides of the narrow width section in the width direction.

13. An ink jet type recording head according to claim 12, wherein a distance from an end of the narrow width section inside the pressure generating chamber to a position at which the narrow width section crosses a first boundary of one of the end portions of the pressure generating chamber in the longitudinal direction, is not less than ½ of the width of the pressure generating chamber.

14. An ink jet type recording head according to claim 13, wherein a plurality of connecting sections are provided at said one of the end portions of the pressure generating chamber in the longitudinal direction.

15. An ink jet type recording head according to claim 14, wherein the connecting section is arranged so that it crosses a second boundary at a corner of the pressure generating chamber.

16. An ink jet type recording head according to claim 15, wherein an opening angle of the corner toward the pressure chamber is an acute angle.

17. An ink jet type recording head according to claim 16, wherein the vibration regulating section is formed when the width of the pressure generating chamber is reduced to be smaller than widths of other portions of said pressure generating chamber.

18. An ink jet type recording head according to claim 17, wherein a boundary between one side of the pressure generating chamber in the width direction and a circumferential wall of the pressure generating chamber is formed to be linear from the vibration regulating section to other portions of the pressure generating chamber.

19. An ink jet type recording head according to claim 18, wherein an edge portion of the piezoelectric active section on one side in the width direction is formed to be linear in the longitudinal direction of the pressure generating chamber from the primary section to the vibration regulating section.

20. An ink jet type recording head according to claim 19, wherein an insulating layer is formed on the upper surface of the piezoelectric active section, and a lead electrode used for impressing voltage on the piezoelectric active section and a contact section for connecting the electrode are arranged in a contact hole formed on the insulating layer.

21. An ink jet type recording head according to claim 20, wherein the lead electrode used for impressing voltage on the piezoelectric active section and the contact section for connecting the electrode are arranged in a portion opposed to the circumferential wall of the pressure generating chamber.

22. An ink jet type recording head according to claim 9, wherein the connecting section is arranged at a position close to either side wall of the pressure generating chamber.

23. An ink jet type recording head according to claim 1, wherein the width of the upper electrode is reduced at a region in the vicinity of the connecting section.

24. An ink jet type recording head according to claim 1, wherein at least a contact surface of the upper electrode coming into contact with the piezoelectric layer is made of conductive oxide film.

25. An ink jet type recording head according to claim 1, wherein the pressure generating chamber is formed when anisotropic etching is conducted on a single crystal silicon base plate and each layer of the piezoelectric vibrator is formed by methods of film formation and lithography.

26. An ink jet type recording head according to claim 1, wherein a width of the piezoelectric active section in a region opposing said pressure generating chamber is smaller than a width of said pressure generating chamber.

27. An ink jet type recording head according to claim 1, wherein a width of the piezoelectric active section on an ink feed port side is larger than the width of said pressure generating chamber.

28. An ink jet type recording head according to claim 1, wherein a width of the upper electrode is reduced to form a signal transmitting passage which extends across the connecting section.

* * * * *